US011160142B2

(12) United States Patent
Page et al.

(10) Patent No.: US 11,160,142 B2
(45) Date of Patent: Oct. 26, 2021

(54) INTERCONNECTABLE HEATING BLANKETS

(71) Applicant: The Boeing Company, Chicago, IL (US)

(72) Inventors: Nicholas R. Page, Charleston, SC (US); Adriano J. Rampolla, Charleston, SC (US); Curt J. Howard, Charleston, SC (US)

(73) Assignee: The Boeing Company, Chicago, IL (US)

( * ) Notice: Subject to any disclaimer, the term of this patent is extended or adjusted under 35 U.S.C. 154(b) by 508 days.

(21) Appl. No.: 15/905,365

(22) Filed: Feb. 26, 2018

(65) Prior Publication Data

US 2019/0268976 A1 Aug. 29, 2019

(51) Int. Cl.
*H05B 3/34* (2006.01)

(52) U.S. Cl.
CPC ..... *H05B 3/342* (2013.01); *H05B 3/34* (2013.01); *H05B 2203/003* (2013.01); *H05B 2203/014* (2013.01); *H05B 2203/016* (2013.01)

(58) Field of Classification Search
CPC ..... H05B 2203/011; H05B 2203/016; H05B 3/06; H05B 3/26; H05B 3/34–38; H05B 3/342; H05B 3/20; H05B 3/22; H05B 2214/02
USPC ..... 219/200–202, 212, 213, 477
See application file for complete search history.

(56) References Cited

U.S. PATENT DOCUMENTS

| | | | | |
|---|---|---|---|---|
| 2,844,696 | A * | 7/1958 | Custer, Jr. | H05B 3/342 219/213 |
| 3,236,991 | A * | 2/1966 | Graham | E01C 11/265 219/213 |
| 5,451,743 | A * | 9/1995 | du Preez | F24D 13/022 219/200 |
| 6,092,587 | A * | 7/2000 | Ingram | F24D 13/02 165/56 |
| 6,278,085 | B1 * | 8/2001 | Abukasm | E01C 11/265 219/213 |
| 6,563,094 | B2 * | 5/2003 | Kochman | H05B 3/34 219/529 |
| 8,169,185 | B2 * | 5/2012 | Partovi | H02J 50/80 320/108 |
| 9,914,269 | B2 * | 3/2018 | Hopkins | H05B 3/34 |
| 2006/0191903 | A1 | 8/2006 | Naylor et al. | |
| 2009/0056244 | A1 * | 3/2009 | Caterina | A01G 13/06 52/169.11 |

(Continued)

FOREIGN PATENT DOCUMENTS

EP 2921084 A1 9/2015

OTHER PUBLICATIONS

"Composite Curing Flexible Heater Blankets," Tempco Electric Heater Corporation, accessed on Feb. 26, 2018, 1 page. https://www.tempco.com/Tempco/Resources/09-Flexible-Resources/CmpstCuringHtrBlnktsCatalogPages.pdf.

(Continued)

*Primary Examiner* — David P Angwin
*Assistant Examiner* — Nicholas A Ros
(74) *Attorney, Agent, or Firm* — Yee & Associates, P.C.

(57) ABSTRACT

An interconnectable heating blanket is presented. The interconnectable heating blanket comprises a first face, a second face, and a plurality of sides. At least one side of the plurality of sides comprises a power connector.

36 Claims, 17 Drawing Sheets

(56) References Cited

U.S. PATENT DOCUMENTS

| | | | | |
|---|---|---|---|---|
| 2012/0145702 | A1* | 6/2012 | Miller | H05B 6/106 219/618 |
| 2015/0373781 | A1* | 12/2015 | Augustine | H05B 3/146 219/212 |
| 2017/0027024 | A1* | 1/2017 | Oloko | H05B 3/342 |
| 2017/0191675 | A1* | 7/2017 | Marti Fibla | F24D 13/02 |
| 2017/0211241 | A1* | 7/2017 | Calinescu | E01C 9/08 |
| 2017/0246815 | A1 | 8/2017 | Kestner et al. | |

OTHER PUBLICATIONS

"Heat Blankets," Heatcon, accessed Feb. 26, 2018, 8 pages. https://www.heatcon.com/product-category/heat-blankets/.

"Atacs 9000: Heater Blanket," Atacs Products, Inc., accessed Feb. 26, 2018, 2 pages. http://www.atacs.com/products/hot-bonders/atacs-9000-heater-blanket/.

Extended European Search Report, dated Jul. 23, 2019, regarding Application No. 18248281.0, 11 pages.

* cited by examiner

INTERCONNECTABLE HEATING BLANKETS

BACKGROUND INFORMATION

1. Field

The present disclosure relates generally to heating components, and more specifically, to heating components using heating blankets. Yet more specifically, the present disclosure relates to heating components using interconnectable heating blankets.

2. Background

To rework an area of a component formed of composite material, the area is removed and replaced with a new portion of composite material. The new portion of composite material is then heated to cure or consolidate. It is desirable to limit the heat transfer to the new portion of composite material as much as possible. It is desirable to only apply enough heat to cure the uncured portion of composite. It is desirable to apply little to no heat to the existing composite structure.

Therefore, it would be desirable to have a method and apparatus that takes into account at least some of the issues discussed above, as well as other possible issues. For example, it would be desirable to provide a method and apparatus that limits delivery of heat to a set size and shape.

SUMMARY

An illustrative embodiment of the present disclosure provides an interconnectable heating blanket. The interconnectable heating blanket comprises a first face, a second face, and a plurality of sides. At least one side of the plurality of sides comprises a power connector.

Another illustrative embodiment of the present disclosure provides a system. The system comprises a first interconnectable heating blanket with a first side, a second interconnectable heating blanket with a second side, and a single power source. The first side of the first interconnectable heating blanket overlaps the second side of the second interconnectable heating blanket to form an interface. The single power source is electrically connected to the first interconnectable heating blanket and the second interconnectable heating blanket.

A further illustrative embodiment of the present disclosure provides an interconnectable heating blanket. The interconnectable heating blanket comprises a first side and a second side. The first side has a first flap of polymeric material overhanging a first edge. The first flap has a first power connector incorporated into the first flap. The second side has a second ledge with a second power connector incorporated into the second ledge.

Another illustrative embodiment of the present disclosure provides a method. An area to be heated for a workpiece is identified. At least one interconnectable heating blanket for the area to be heated is identified. The at least one interconnectable heating blanket is placed in contact with the area to be heated. The area to be heated is heated using the at least one interconnectable heating blanket.

Yet another illustrative embodiment of the present disclosure provides a method. A first interconnectable heating blanket is connected to a second interconnectable heating blanket to form a system. An area to be heated of a workpiece is heated using the system. Heating the area to be heated of the workpiece comprises providing power to the first interconnectable heating blanket and the second interconnectable heating blanket from a single power source by providing power directly to the first interconnectable heating blanket from the single power source and providing power to the second interconnectable heating blanket from the single power source through the first interconnectable heating blanket.

The features and functions can be achieved independently in various embodiments of the present disclosure or may be combined in yet other embodiments in which further details can be seen with reference to the following description and drawings.

BRIEF DESCRIPTION OF THE DRAWINGS

The novel features believed characteristic of the illustrative embodiments are set forth in the appended claims. The illustrative embodiments, however, as well as a preferred mode of use, further objectives and features thereof, will best be understood by reference to the following detailed description of an illustrative embodiment of the present disclosure when read in conjunction with the accompanying drawings, wherein:

DETAILED DESCRIPTION

Figure 1A:
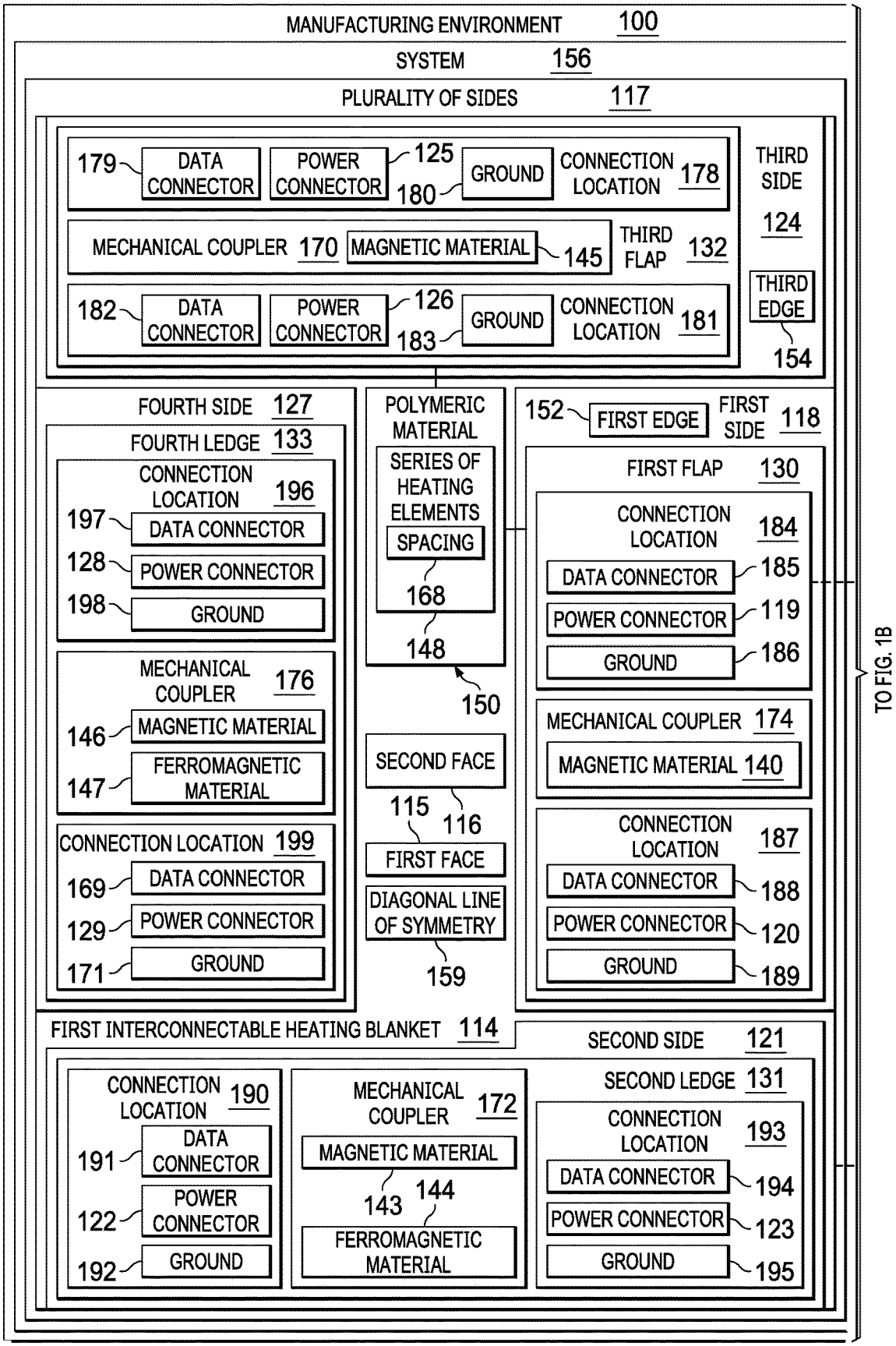
FIGS. 1A and 1B are an illustration of a block diagram of a manufacturing environment in which interconnectable heating blankets are used to heat a component in accordance with an illustrative embodiment.

The illustrative embodiments recognize and take into account one or more different considerations. For example, the illustrative embodiments recognize and take into account that heating blankets are often used to apply heat to composite material. The illustrative embodiments recognize and take into account that heating blankets are often used to heat composite material when reworking a component.

The illustrative embodiments recognize and take into account that heating blankets are provided in set sizes and shapes. The illustrative embodiments recognize and take into account that standard heating blankets are rectangular mats formed of silicone and containing heating elements. The illustrative embodiments recognize and take into account that standard heating blankets may reach up to 450 degrees Fahrenheit and some high temperature heating blankets may reach up to 1100 degrees Fahrenheit.

The illustrative embodiments recognize and take into account that when a heating blanket is undesirably larger than an area to be heated, a different heating blanket with desirable dimensions may be ordered. The illustrative embodiments recognize and take into account that it may be desirable for the ordered heating blanket to have dimensions close to dimensions of the area to be heated.

The illustrative embodiments recognize and take into account that when a heating blanket is smaller than an area to be heated, a larger heating blanket may be ordered. The illustrative embodiments recognize and take into account that ordering new heating blankets may be undesirably costly. The illustrative embodiments recognize and take into account that ordering new heating blankets may cause a time delay. The illustrative embodiments recognize and take into account that heating blankets take up storage space.

The illustrative embodiments recognize and take into account that operators may attempt to join two heating blankets to heat a larger area than heated by either heating blankets individually. The illustrative embodiments recognize and take into account that to "join" two conventional heating blankets, aluminum tape is used to tape the heating blankets together. The illustrative embodiments recognize and take into account that the two separate heating blankets use two separate power sources.

The illustrative embodiments recognize and take into account that when the two heating blankets are taped together, a gap exists between the heating elements of the two heating blankets. The illustrative embodiments recognize and take into account that an area of a component beneath the junction of the two heating blankets is significantly cooler than the areas of the component beneath the two heating blankets. The illustrative embodiments recognize and take into account that when the two heating blankets are taped together, time consuming testing is performed to confirm the two heating blankets are achieving desired heat transfer.

The illustrative embodiments recognize and take into account that in some instances, operators may choose to use existing heating blankets rather than reorder or combine heating blankets. Although using existing heating blankets may result in undesirable heat transfer, using existing heating blankets may be less expensive or less time consuming than other options.

The illustrative embodiments recognize and take into account that areas to be heated may have non-rectangular shapes. The illustrative embodiments recognize and take into account that a rectangular heating blanket large enough to cover a non-rectangular area to be heated may undesirably heat areas due to the non-rectangular shape of the area to be heated.

Figure 1B:
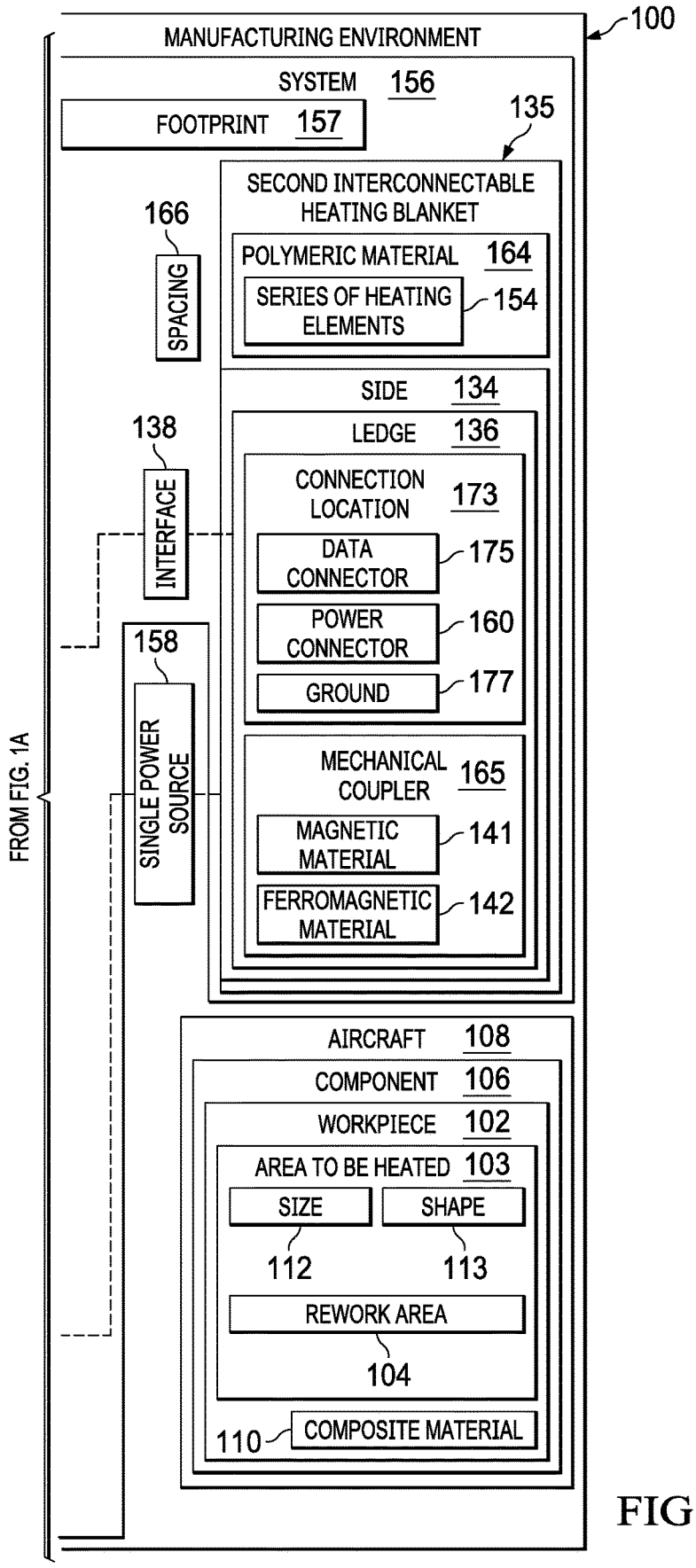

Referring now to the figures and, in particular, with reference to FIGS. 1A and 1B, an illustration of a block diagram of a manufacturing environment in which interconnectable heating blankets are used to heat a component is depicted in accordance with an illustrative embodiment. Manufacturing environment 100 contains workpiece 102 having area to be heated 103. In some illustrative examples, area to be heated 103 takes the form of rework area 104. In some illustrative examples, workpiece 102 is component 106 of aircraft 108. As depicted, workpiece 102 is formed of composite material 110. Area to be heated 103 has size 112 and shape 113.

To process area to be heated 103, it is desirable to apply heat to area to be heated 103. To process area to be heated 103, it is also desirable to reduce heat applied to portions of workpiece 102 outside of area to be heated 103. When workpiece 102 is component 106 of aircraft 108, it is also desirable to reduce heat applied to other portions of aircraft 108 outside of area to be heated 103.

First interconnectable heating blanket 114 is present in manufacturing environment 100. First interconnectable heating blanket 114 may be used to apply heat to area to be heated 103 of component 106.

First interconnectable heating blanket 114 comprises first face 115, second face 116, and plurality of sides 117. At least one side of plurality of sides 117 comprises a power connector. In some illustrative examples, each of plurality of sides 117 comprises a power connector. As depicted, plurality of sides 117 comprises first side 118, second side 121, third side 124, and fourth side 127. As depicted, first side 118 comprises power connector 119 and power connector 120. As depicted, second side 121 comprises power connector 122 and power connector 123. As depicted, third side 124 comprises power connector 125 and power connector 126. As depicted, fourth side 127 comprises power connector 128 and power connector 129.

Each interconnectable heating blanket, such as first interconnectable heating blanket 114, can connect with a maximum quantity of other heating blankets on a respective side based on the quantity of power connectors on the respective edge. For example, on first side 118, first interconnectable heating blanket 114 has two power connectors: power connector 119 and power connector 120. When first interconnectable heating blanket 114 has two power connectors on first side 118, first interconnectable heating blanket 114 can connect to up to two other heating blankets on first side 118. Each power connector is a termination point of wires which run inside the structure of first interconnectable heating blanket 114.

Only one power connector is required to tie a interconnectable heating blanket into system 156. More than one power connector may be provided on each side, such as first side 118, second side 121, third side 124, and fourth side 127 so that additional options for footprint 157 may be constructed for system 156. For example, additional options for footprint 157 of system 156 are available when more than one interconnectable heating blanket may be connected to any of first side 118, second side 121, third side 124, or fourth side 127.

The at least one side comprising a power connector further comprises a ledge or a flap. In some illustrative examples, each of plurality of sides 117 of first interconnectable heating blanket 114 comprises a ledge or a flap. As depicted, first side 118 comprises first flap 130. As depicted, second side 121 comprises second ledge 131. As depicted, third side 124 comprises third flap 132. As depicted, fourth side 127 comprises fourth ledge 133.

A flap, such as first flap 130, acts as a mechanical connection feature with a side of another heating blanket, such as side 134 of second interconnectable heating blanket 135. A flap will act as a mechanical connection with a respective ledge. The mechanical connection will create a substantially continuous surface for system 156. As depicted, first flap 130 overlaps ledge 136 of side 134 to form interface 138.

A flap, such as first flap 130, also acts as a thermal connection with another heating blanket, such as second interconnectable heating blanket 135. A flap, such as first flap 130, conducts heat through an interface, such as interface 138 formed by first side 118 and side 134 of second interconnectable heating blanket 135. By acting as a thermal connection, first flap 130, in addition to mechanically and electrically connecting first interconnectable heating blanket 114 and second interconnectable heating blanket 135, also acts as a gap insulator to transition the heat gradient from one interconnectable heating blanket to the other and reduce cold spots.

As depicted, series of heating elements 148 do not extend into interface 138. Accordingly, conductive heating between first interconnectable heating blanket 114 and second interconnectable heating blanket 135 provides heat below interface 138. In some illustrative examples, first flap 130 is configured to provide a desired transmission of heat.

In some illustrative examples, the at least one side comprising a power connector further comprises a respective mechanical coupler. In some illustrative examples, each of plurality of sides 117 of first interconnectable heating blanket 114 comprises a mechanical coupler. Mechanical couplers may take any desirable form. In some illustrative examples, each respective mechanical coupler is at least one of a magnetic material or a ferromagnetic material. In some illustrative examples, each of plurality of sides 117 of first interconnectable heating blanket 114 comprises one of a magnetic material or a ferromagnetic material. In some illustrative examples, flaps comprise a magnetic material while ledges comprise a magnetic material or a ferromagnetic material.

In some illustrative examples, the underside of a male flap, such as first flap 130, is lined with a high strength natural magnet. Magnetic material 140 can be segmented for improved flexibility. Similarly, the topside of a female connector, such as second ledge 131, may be lined with ferromagnetic material 144, such as a ferrous metallic strip, or other desirable material.

As depicted, first side 118 comprises magnetic material 140. As depicted, magnetic material 140 is within first flap 130. Magnetic material 140 magnetically holds first flap 130 to a respective ledge, such as ledge 136 of second interconnectable heating blanket 135. Ledge 136 comprises one of magnetic material 141 or ferromagnetic material 142. The one of magnetic material 141 or ferromagnetic material 142 is selected to be attracted to magnetic material 140.

In some illustrative examples, mechanical coupler 165 of side 134 may take a different form than magnetic material 141 or ferromagnetic material 142. For example, mechanical coupler 165 may take the form of hook and loop fasteners, a zipper, tape, or any other desirable type of mechanical coupler.

As depicted, second side 121 comprises one of magnetic material 143 or ferromagnetic material 144. The one of magnetic material 143 or ferromagnetic material 144 is within second ledge 131.

As depicted, third side 124 comprises magnetic material 145. As depicted, magnetic material 145 is within third flap 132.

As depicted, fourth side 127 comprises fourth ledge 133. As depicted, fourth side 127 comprises one of magnetic material 146 or ferromagnetic material 147. The one of magnetic material 146 or ferromagnetic material 147 is within fourth ledge 133.

In some illustrative examples, each of plurality of sides 117 of first interconnectable heating blanket 114 comprises a different kind of mechanical coupler than a magnetic material. Mechanical couplers may take any desirable form.

In some illustrative examples, mechanical coupler 170 of first side 118 may take a different form than magnetic material 140. For example, mechanical coupler 170 may take the form of hook and loop fasteners, a zipper, tape, or any other desirable type of mechanical coupler. In some illustrative examples, mechanical couplers of first interconnectable heating blanket 114 may all take the same form. In some illustrative examples, first interconnectable heating blanket 114 comprises more than one type of mechanical coupler.

In some illustrative examples, mechanical coupler 172 of second side 121 may take a different form than magnetic material 143 or ferromagnetic material 144. For example, mechanical coupler 172 may take the form of hook and loop fasteners, a zipper, tape, or any other desirable type of mechanical coupler.

In some illustrative examples, mechanical coupler 174 of third side 124 may take a different form than magnetic material 145. For example, mechanical coupler 174 may take the form of hook and loop fasteners, a zipper, tape, or any other desirable type of mechanical coupler.

In some illustrative examples, mechanical coupler 176 of fourth side 127 may take a different form than magnetic material 146 or ferromagnetic material 147. For example, mechanical coupler 176 may take the form of hook and loop fasteners, a zipper, tape, or any other desirable type of mechanical coupler.

First interconnectable heating blanket 114 includes series of heating elements 148 encompassed by polymeric material 150. Series of heating elements 148 extends to within one inch or less of each of plurality of sides 117. First interconnectable heating blanket 114 is configured to heat at least a portion of area to be heated 103 of component 106 of aircraft 108 using heat from series of heating elements 148 transmitted through first face 115.

In some illustrative examples, first interconnectable heating blanket 114 comprises first side 118 and second side 121. First side 118 has first flap 130 of polymeric material 150 overhanging first edge 152, wherein first flap 130 has a first power connector, power connector 119, incorporated into first flap 130. Second side 121 has second ledge 131 with a second power connector, power connector 122, incorporated into second ledge 131.

In some illustrative examples, first interconnectable heating blanket 114 further comprises third side 124 and fourth side 127. Third side 124 has third flap 132 of polymeric material 150 overhanging third edge 154, wherein third flap 132 has a third power connector, power connector 125, incorporated into third flap 132. Fourth side 127 has fourth ledge 133 with a fourth power connector, power connector 128, incorporated into fourth ledge 133.

As depicted, first side 118 and third side 124 are perpendicular to each other. In some illustrative examples, first side 118 and third side 124 are adjacent to each other but not perpendicular. Each of first side 118, second side 121, third side 124, and fourth side 127 may have any desirable size or shape. In some illustrative examples, first side 118, second side 121, third side 124, and fourth side 127 are linear. In some illustrative examples, each of first side 118, second side 121, third side 124, and fourth side 127 are substantially the same length. In some illustrative examples, each of first side 118, second side 121, third side 124, and fourth side 127 are substantially straight. In some illustrative examples, at least one of first side 118, second side 121, third side 124, or fourth side 127 is curved.

Other interconnectable heating blankets, such as second interconnectable heating blanket 135, have sides configured to be complementary to at least a portion of at least one of first side 118, second side 121, third side 124, or fourth side 127. For example, a shape (not depicted) of side 134 is complementary to a shape (not depicted) of at least a portion of first side 118.

As used herein, the phrase "at least one of," when used with a list of items, means different combinations of one or more of the listed items may be used, and only one of each item in the list may be needed. In other words, "at least one of" means any combination of items and number of items may be used from the list, but not all of the items in the list are required. The item may be a particular object, a thing, or a category.

This example also may include item A, item B, and item C, or item B and item C. Of course, any combination of these items may be present. In other examples, "at least one of" may be, for example, without limitation, two of item A, one of item B, and ten of item C; four of item B and seven of item C; or other suitable combinations.

In some illustrative examples, first side 118 further comprises a third power connector, power connector 120, incorporated into first flap 130. As depicted, first side 118 includes two power connectors: power connector 119 and power connector 120.

In some illustrative examples, second side 121 further comprises a fourth power connector, power connector 123, incorporated into second ledge 131. As depicted, second side 121 includes two power connectors: power connector 122 and power connector 123.

As depicted, first interconnectable heating blanket 114 comprises series of heating elements 148 encompassed by polymeric material 150. Series of heating elements 148 extend to within one inch or less from first edge 152. In some illustrative examples, series of heating elements 148 extend to within one inch or less from each edge of first interconnectable heating blanket 114.

In some illustrative examples, first interconnectable heating blanket 114 is symmetrical. As depicted, first interconnectable heating blanket 114 may be symmetrical about a diagonal line of symmetry 159 extending between third side 124 and first side 118.

System 156 comprises at least one interconnectable heating blanket. System 156 contains any desirable quantity and any desirable shapes of interconnectable heating blankets. The total number of square feet of interconnectable heating blankets in system 156 on a single 220V outlet may be proportional to the desired temperatures to be provided by the interconnectable heating blankets. The higher temperatures to be provided by the interconnectable heating blankets in system 156, the higher the current draw by the interconnectable heating blankets. In some illustrative examples, system 156 contains up to 9 square feet of interconnectable heating blankets on a 220V outlet. For some temperatures, over 9 square feet may not be effectively heated using a single 220V power source. Interconnectable heating blankets of system 156 are selected to cover area to be heated 103 of workpiece 102.

In some illustrative examples, system 156 comprises first interconnectable heating blanket 114 with first side 118, second interconnectable heating blanket 135 with side 134, and single power source 158 electrically connected to first interconnectable heating blanket 114 and second interconnectable heating blanket 135. First side 118 of first interconnectable heating blanket 114 overlaps side 134 of second interconnectable heating blanket 135 to form interface 138.

First side 118 of first interconnectable heating blanket 114 has first flap 130 of polymeric material 150 with a first power connector, power connector 119, incorporated into first flap 130. Side 134 of second interconnectable heating blanket 135 has ledge 136 with power connector 160 incorporated into the ledge 136. In these illustrative examples, side 134 may be referred to as a second side, power connector 160 may be referred to as a second power connector, and ledge 136 may be referred to as a second ledge. A first power connector, power connector 119, and second power connector, power connector 160, are connected to provide power to first interconnectable heating blanket 114 and second interconnectable heating blanket 135 from single power source 158.

Second interconnectable heating blanket 135 includes series of heating elements 162 encompassed by polymeric material 164. In some illustrative examples, spacing 166 between series of heating elements 148 of first interconnectable heating blanket 114 and series of heating elements 162 of second interconnectable heating blanket 135 at interface 138 is substantially the same as spacing 168 between series of heating elements 148 of first interconnectable heating blanket 114.

As depicted, each respective power connector of first interconnectable heating blanket 114 is positioned at a respective connection location. In some illustrative examples, each respective connection location may also provide additional functionality. For example, each respective connection location may also provide at least one of a ground or a data connection.

For example, as depicted, power connector 125 is positioned at connection location 178. As depicted, connection location 178 also contains data connector 179 and ground 180. As depicted, power connector 126 is positioned at connection location 181 that also contains data connector 179 and ground 183.

As depicted, power connector 119 of first flap 130 is positioned at connection location 184. As depicted, connection location 184 also contains data connector 185 and ground 186. As depicted, power connector 120 is positioned at connection location 187 that also contains data connector 188 and ground 189.

As depicted, power connector 122 of second ledge 131 is positioned at connection location 190. As depicted, connection location 190 also contains data connector 191 and ground 192. As depicted, power connector 123 is positioned at connection location 193 that also contains data connector 194 and ground 195.

As depicted, power connector 128 of fourth ledge 133 is positioned at connection location 196. As depicted, connection location 196 also contains data connector 197 and ground 198. As depicted, power connector 129 is positioned at connection location 199 that also contains data connector 169 and ground 171.

As depicted, power connector 160 of second interconnectable heating blanket 135 is positioned at connection location 173. Connection location 173 also contains data connector 175 and ground 177. In some illustrative examples, when data connector 185 and data connector 175 are present, data may be transferred regarding first interconnectable heating blanket 114 and second interconnectable heating blanket 135 to a computer (not depicted). In some illustrative examples, when data connector 185 and data connector 175 are present, a controller (not depicted) may communicate with both first interconnectable heating blanket 114 and second interconnectable heating blanket 135.

The illustration of manufacturing environment 100 in FIG. 1 is not meant to imply physical or architectural limitations to the manner in which an illustrative embodiment may be implemented. Other components in addition to or in place of the ones illustrated may be used. Some components may be unnecessary. Also, the blocks are presented to illustrate some functional components. One or more of these blocks may be combined, divided, or combined and divided into different blocks when implemented in an illustrative embodiment.

For example, although two interconnectable heating blankets are depicted, system 156 may contain any desirable quantity of interconnectable heating blankets. Further, first interconnectable heating blanket 114 may have any desirable quantity of sides. Additionally, each of the sides of first interconnectable heating blanket 114 may have any desirable quantity of power connectors.

The interconnectable heating blankets may be of any desirable size or shape. The interconnectable heating blankets may be square, rectangular, triangular, or any other desirable shape. In some illustrative examples, the interconnectable heating blankets have rounded sides. For example, first interconnectable heating blanket 114 may have any desirable shape and any desirable size.

As another example, although not depicted, a number of covers may be used to cover unused power connectors in system 156. Covers may be integral to an interconnectable heating blanket, such as first interconnectable heating blanket 114 or separate components, such as a sleeve. A cover may be used at least one of during storage or during operation of an interconnectable heating blanket, such as first interconnectable heating blanket 114. Covers may be made out of any desirable material. When covers will be used during operation of the interconnectable heating blanket, the covers are formed of a material configured to withstand the heating temperatures of the interconnectable heating blanket.

Although system 156 is described as applying heat to area to be heated 103, system 156 may apply heat to any desirable area. For example, system 156 may apply heat to a workpiece 102 to initially form workpiece 102. Further, system 156 may be used to apply heat to workpieces formed of a material other than composite material 110.

Figure 2:
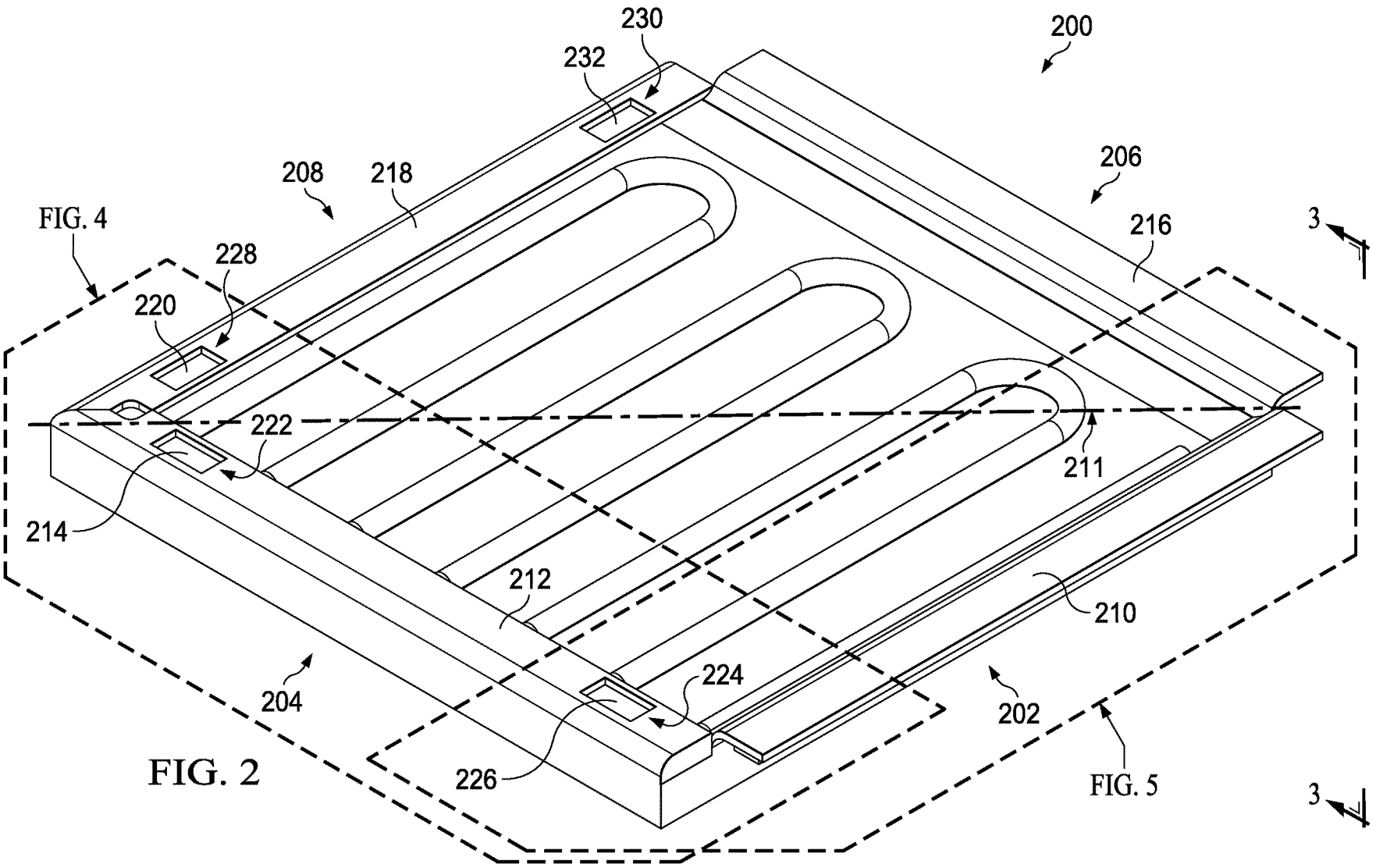
FIG. 2 is an illustration of a top isometric view of an interconnectable heating blanket in accordance with an illustrative embodiment.

Turning now to FIG. 2, an illustration of a top isometric view of an interconnectable heating blanket is depicted in accordance with an illustrative embodiment. Interconnectable heating blanket 200 is a physical implementation of one of first interconnectable heating blanket 114 or second interconnectable heating blanket 135.

Interconnectable heating blanket 200 comprises plurality of sides 201, including first side 202, second side 204, third side 206, and fourth side 208. First side 202 has first flap 210 of polymeric material 211 overhanging a first edge (not depicted). Second side 204 has second ledge 212 with second power connector 214 incorporated into second ledge 212. Third side 206 has third flap 216 of polymeric material 211 overhanging a third edge (not depicted). Fourth side 208 has fourth ledge 218 with fourth power connector 220 incorporated into fourth ledge 218.

As depicted, first side 202 and third side 206 are perpendicular to each other. As depicted, interconnectable heating blanket 200 is symmetrical. More specifically, as depicted, interconnectable heating blanket 200 is symmetric about a diagonal line of symmetry 221.

As depicted, each of second ledge 212 and fourth ledge 218 has more than one respective connection location. In this illustrative example, each respective connection location has a respective power connector. For example, second ledge 212 has connection location 222 with second power connector 214 and connection location 224 with power connector 226. Fourth ledge 218 has connection location 228 with fourth power connector 220 and connection location 230 with power connector 232. Although both second ledge 212 and fourth ledge 218 are depicted with two respective connection locations, second ledge 212 and fourth ledge 218 may contain any desirable quantity of connection locations. Further, connection locations of second ledge 212 and fourth ledge 218 may be placed in any desirable locations.

As depicted, second face 233 of interconnectable heating blanket 200 is visible. Interconnectable heating blanket 200 comprises series of heating elements 234 encompassed by polymeric material 211. Series of heating elements 234 extends to within one inch or less of each of plurality of sides 201. Although series of heating elements 234 is depicted as coils 236, in other illustrative examples, series of heating elements 234 may take other forms. For example, series of heating elements 234 may instead take the form of a grid.

The illustration of interconnectable heating blanket 200 in FIG. 2 is not meant to imply physical or architectural limitations to the manner in which an illustrative embodiment may be implemented. A physical implementation of first interconnectable heating blanket 114 may have any desirable quantity of sides. Additionally, each of the sides may have any desirable quantity of connection points. Further, interconnectable heating blanket 200 may have any desirable shape and any desirable size.

Figure 3:
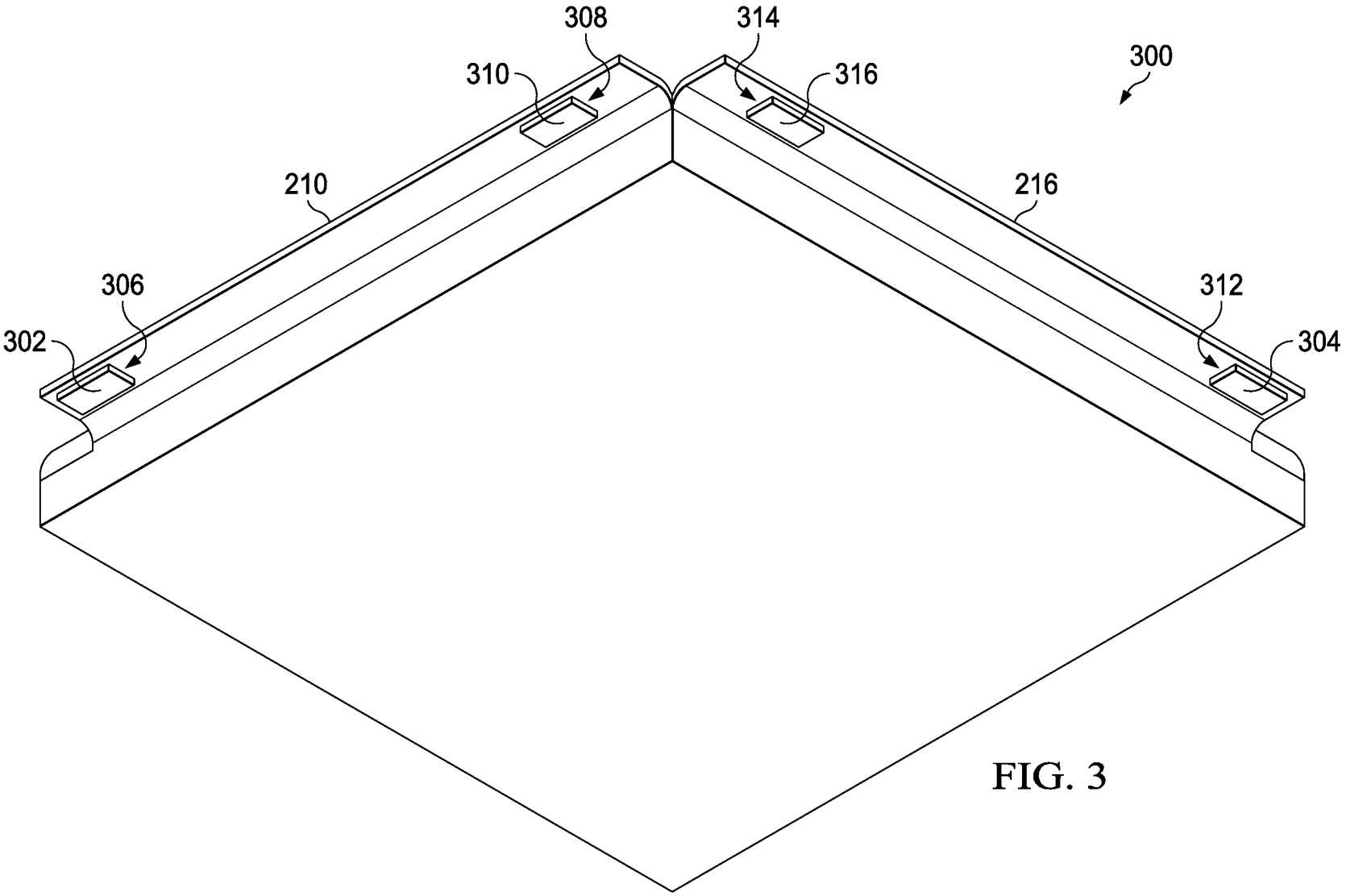
FIG. 3 is an illustration of a bottom isometric view of an interconnectable heating blanket in accordance with an illustrative embodiment.

Turning now to FIG. 3, an illustration of a bottom isometric view of an interconnectable heating blanket is depicted in accordance with an illustrative embodiment. View 300 is a view of interconnectable heating blanket 200 of FIG. 2 from direction 3.

As can be seen in view 300, first flap 210 has first power connector 302 incorporated into first flap 210. Third flap 216 has third power connector 304 incorporated into third flap 216.

As depicted, each of first flap 210 and third flap 216 has more than one respective connection location. In this illustrative example, each respective connection location has a respective power connector. For example, first flap 210 has connection location 306 with first power connector 302 and connection location 308 with power connector 310. Third flap 216 has connection location 312 with third power connector 304 and connection location 314 with power connector 316. Although both first flap 210 and third flap 216 are depicted with two respective connection locations, first flap 210 and third flap 216 may contain any desirable quantity of connection locations. Further, connection locations of first flap 210 and third flap 216 may be placed in any desirable locations.

Figure 4:
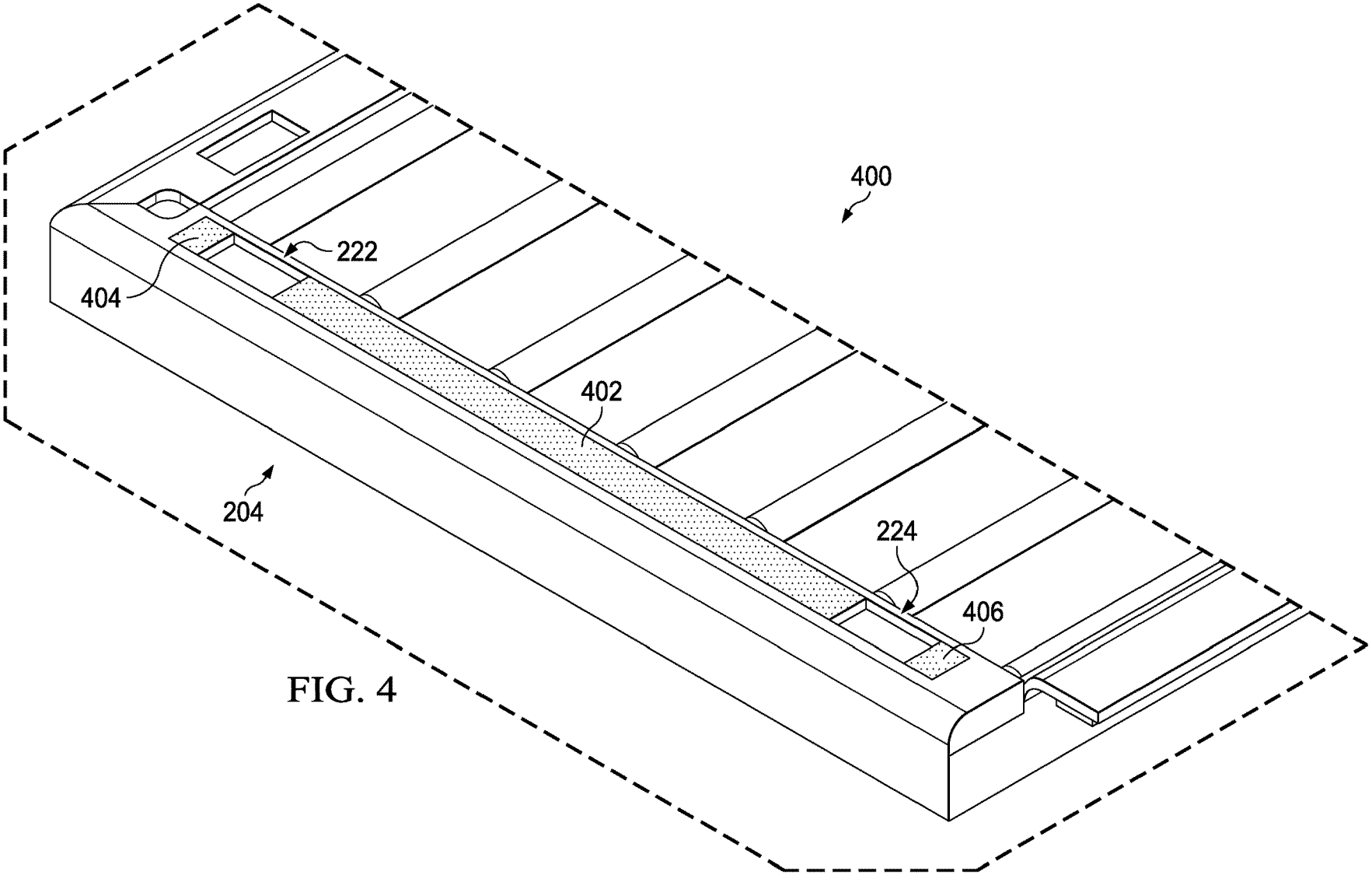
FIG. 4 is an illustration of a top view of a second side of an interconnectable heating blanket in accordance with an illustrative embodiment.

Turning now to FIG. 4, an illustration of a top view of a second side of an interconnectable heating blanket is depicted in accordance with an illustrative embodiment. View 400 is a top view of second side 204 of FIG. 2. As depicted in view 400, ferromagnetic material 402 is present between connection location 222 and connection location 224. As depicted, ferromagnetic material 404 and ferromagnetic material 406 are also present in second ledge 212. To connect interconnectable heating blanket 200 to another interconnectable heating blanket (not depicted), at least one of ferromagnetic material 402, ferromagnetic material 404, or ferromagnetic material 406 is attracted to a magnetic material of the other interconnectable heating blanket (not depicted).

Figure 5:
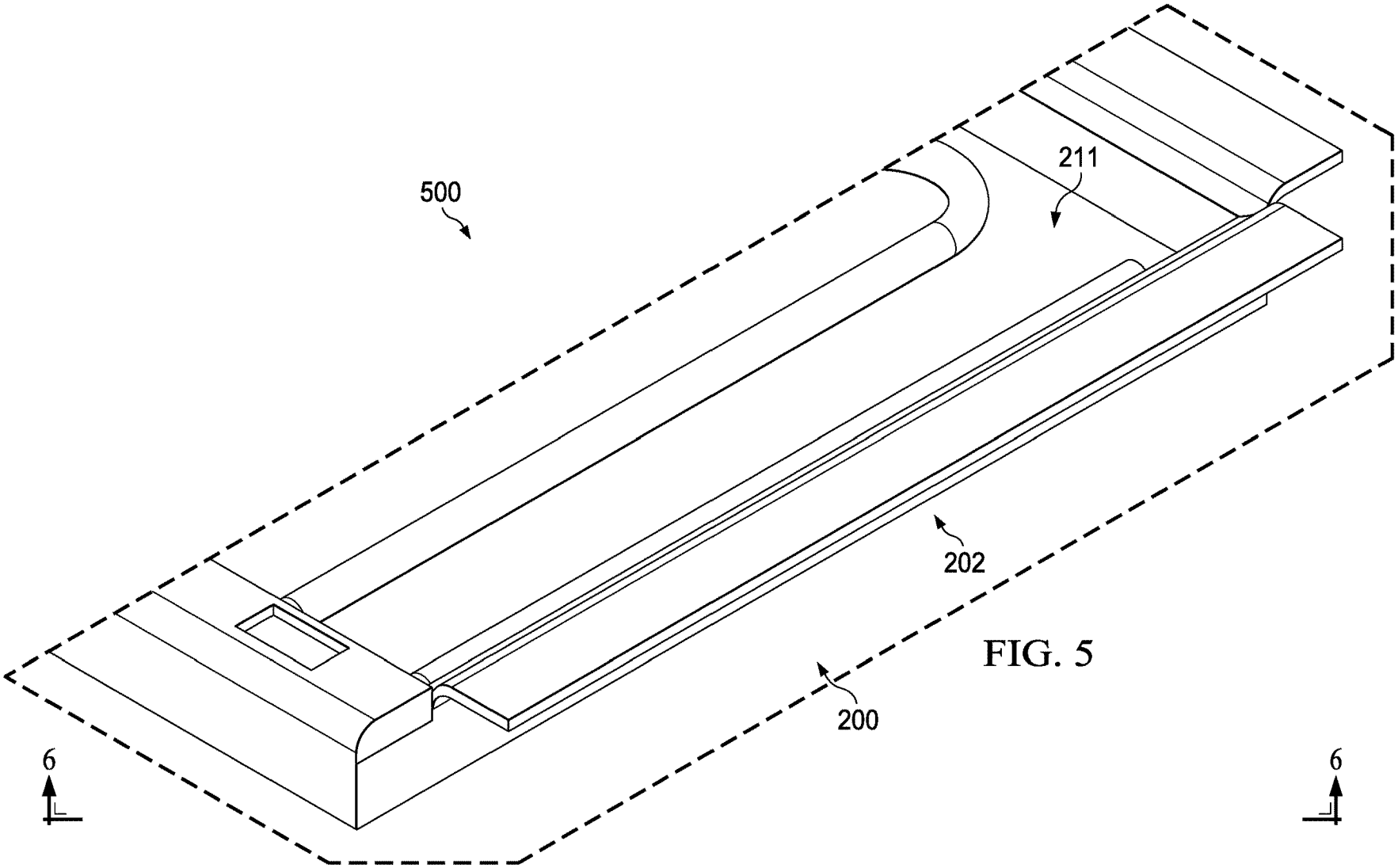
FIG. 5 is an illustration of a top isometric view of a first side of an interconnectable heating blanket in accordance with an illustrative embodiment.

Turning now to FIG. 5, an illustration of a top isometric view of a first side of an interconnectable heating blanket is depicted in accordance with an illustrative embodiment. View 500 is a view of first side 202 of interconnectable heating blanket 200 of FIG. 2 from direction 5. Polymeric material 211 is visible in view 500.

Figure 6:
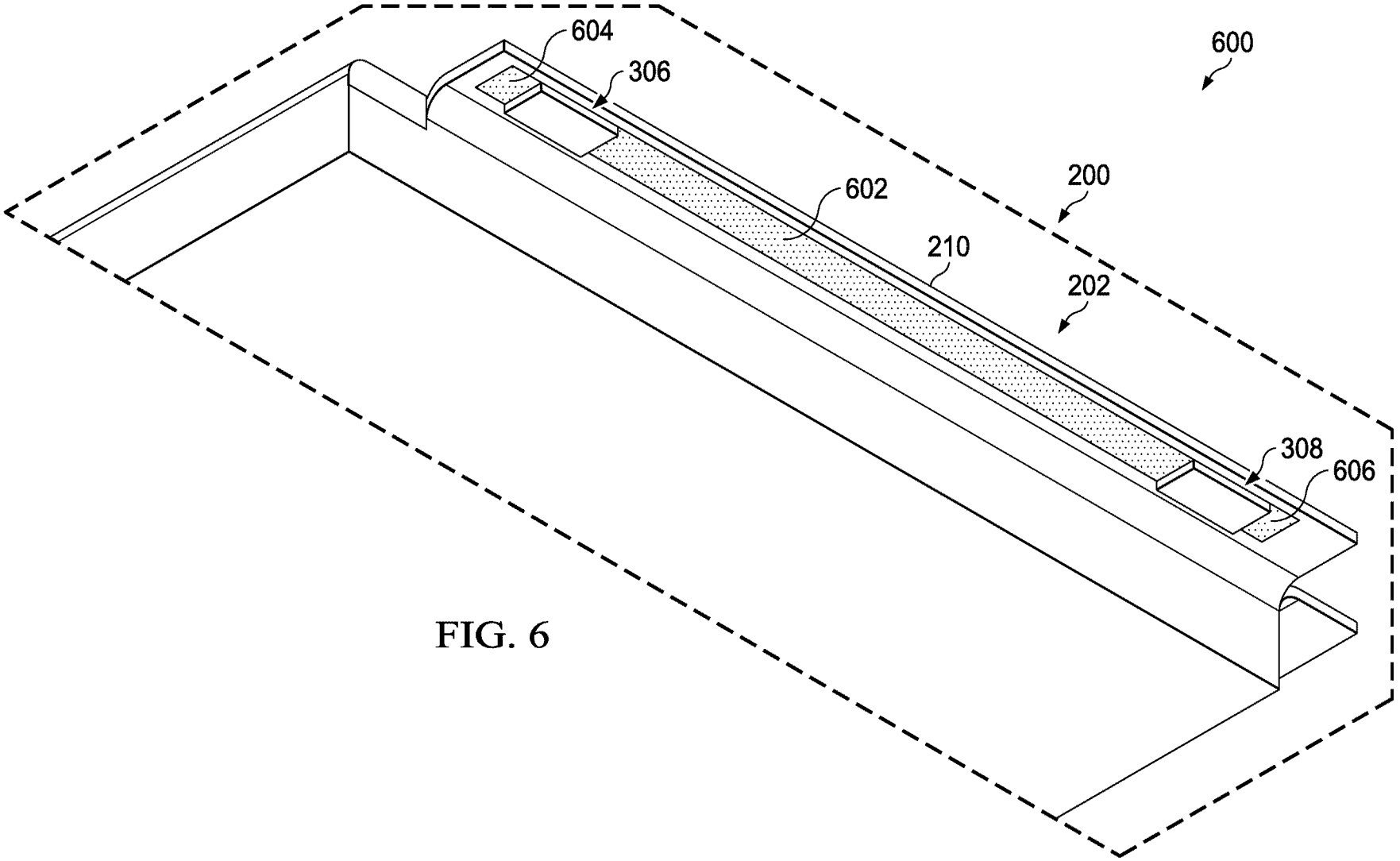
FIG. 6 is an illustration of a bottom isometric view of a first side of an interconnectable heating blanket in accordance with an illustrative embodiment.

Turning now to FIG. 6, an illustration of a bottom isometric view of a first side of an interconnectable heating blanket is depicted in accordance with an illustrative embodiment. View 600 is a view of first side 202 of interconnectable heating blanket 200 of FIG. 2 from direction 6.

As depicted in view 600, magnetic material 602 is present between connection location 306 and connection location 308. As depicted, magnetic material 604 and magnetic material 606 are also present in first flap 210. To connect interconnectable heating blanket 200 to another interconnectable heating blanket (not depicted), at least one of magnetic material 602, magnetic material 604, or magnetic material 606 is attracted to a magnetic material or ferromagnetic material of the other interconnectable heating blanket (not depicted).

Figure 7:
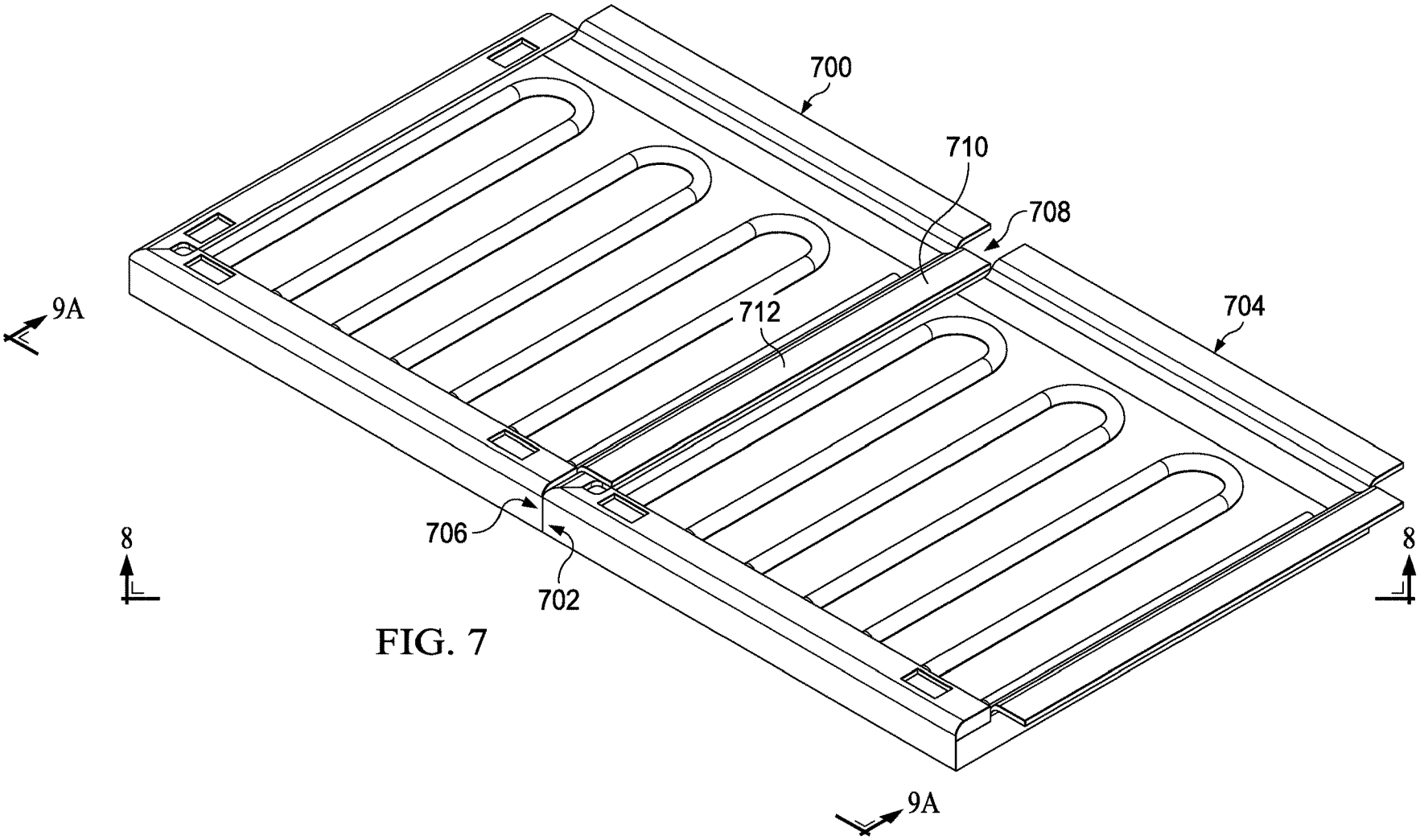
FIG. 7 is an illustration of a top isometric view of a first interconnectable heating blanket and a second interconnectable heating blanket forming an interface in accordance with an illustrative embodiment.

Turning now to FIG. 7, an illustration of a top isometric view of a first interconnectable heating blanket and a second interconnectable heating blanket forming an interface is depicted in accordance with an illustrative embodiment. First interconnectable heating blanket 700 is a physical implementation of first interconnectable heating blanket 114 of FIG. 1. In some illustrative examples, first interconnectable heating blanket 700 is an implementation of interconnectable heating blanket 200 of FIG. 2.

First interconnectable heating blanket 700 has first side 702. Second interconnectable heating blanket 704 has second side 706. First side 702 of first interconnectable heating blanket 700 overlaps second side 706 of second interconnectable heating blanket 704 to form interface 708. More specifically, first flap 710 of first side 702 overlaps a second ledge (not depicted) of second interconnectable heating blanket 704. Interface 708 allows for a single power source to be electrically connected to first interconnectable heating blanket 700 and second interconnectable heating blanket 704.

Second interconnectable heating blanket 704 is a physical implementation of second interconnectable heating blanket 135 of FIG. 1. In some illustrative examples, second interconnectable heating blanket 704 is an implementation of interconnectable heating blanket 200 of FIG. 2.

First side 702 of first interconnectable heating blanket 700 has first flap 710 of polymeric material 712 with a first power connector (not depicted) incorporated into first flap 710. Second side 706 of second interconnectable heating blanket 704 has a second ledge (not depicted) with a second power connector (not depicted) incorporated into the second ledge (not depicted). When first flap 710 overlaps the second ledge, the first power connector (not depicted) and the second power connector (not depicted) are connected to provide power to first interconnectable heating blanket 700 and second interconnectable heating blanket 704 from the single power source.

In some illustrative examples, first flap 710 is held against second ledge (not depicted) using a magnetic force. In some illustrative examples, first flap 710 comprises a magnetic material (not depicted), and the second ledge (not depicted) comprises a magnetic material (not depicted) or a ferromagnetic material (not depicted).

Figure 8:
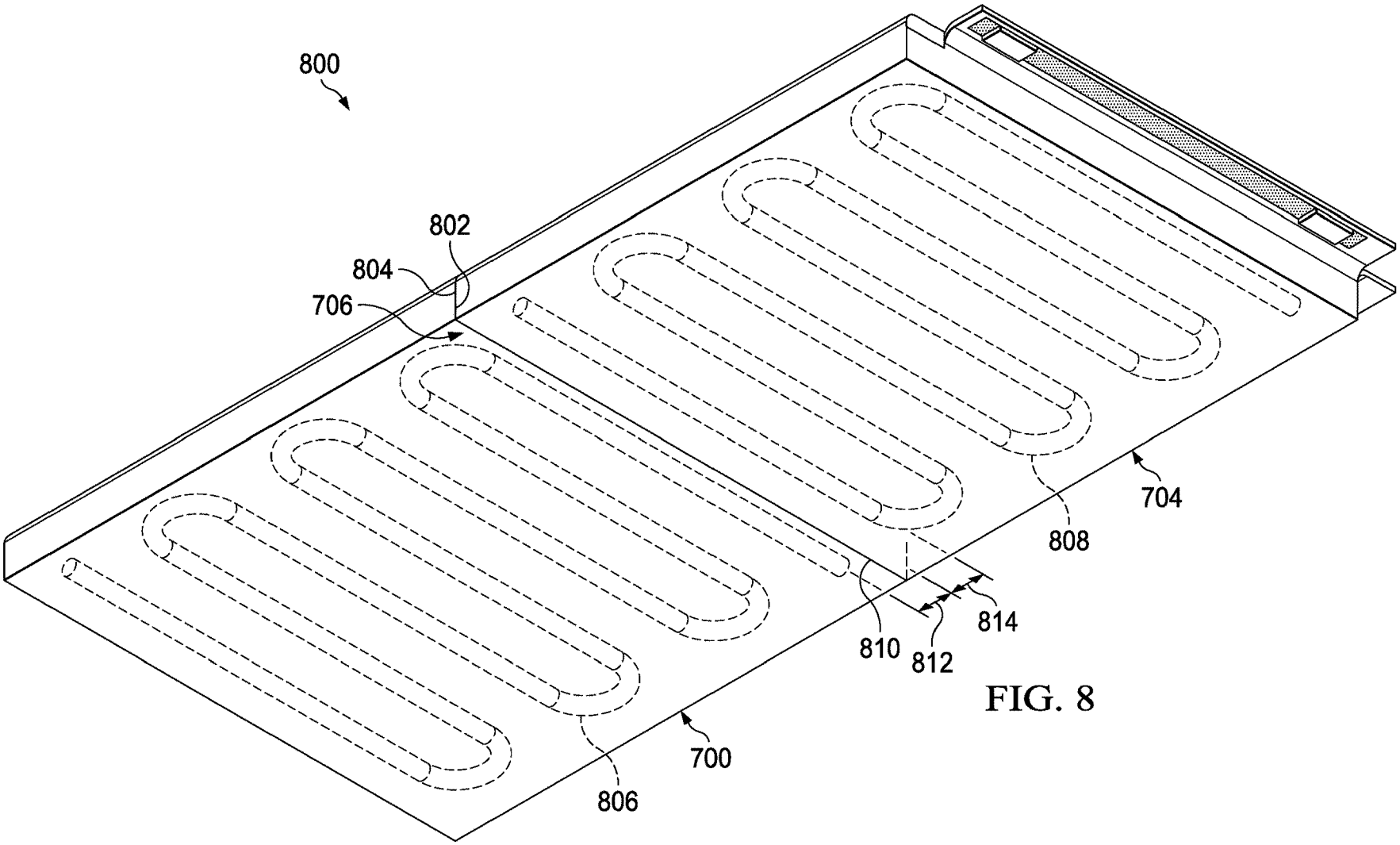
FIG. 8 is an illustration of a bottom isometric view of a first interconnectable heating blanket and a second interconnectable heating blanket forming an interface in accordance with an illustrative embodiment.

Turning now to FIG. 8, an illustration of a bottom isometric view of a first interconnectable heating blanket and a second interconnectable heating blanket forming an interface is depicted in accordance with an illustrative embodiment. View 800 is a view of first interconnectable heating blanket 700 and second interconnectable heating blanket 704 from direction 8 of FIG. 7.

In view 800, first edge 802 of first interconnectable heating blanket 700 is visible. In view 800, second edge 804 of second interconnectable heating blanket 704 is visible. As depicted, first edge 802 and second edge 804 are in contact.

Heating elements 806 of first interconnectable heating blanket 700 extend to within one inch or less from a first edge 802 of first side 702. Heating elements 808 of second interconnectable heating blanket 704 extend to within one inch or less from second edge 810 of second side 706. Spacing 812 between series of heating elements 806 of first interconnectable heating blanket 700 and heating elements 808 of second interconnectable heating blanket 704 at interface 708 is substantially the same as spacing 814 between series of heating elements 806 of first interconnectable heating blanket 700.

Figure 9A:
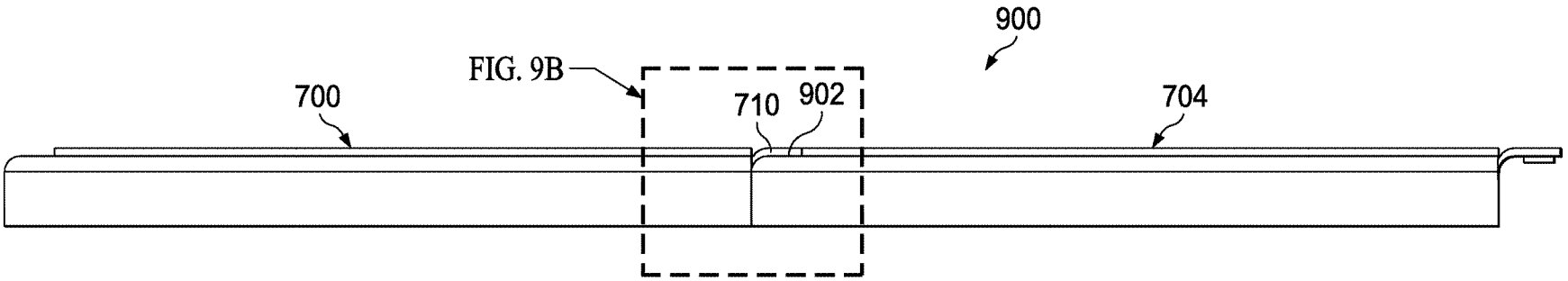
FIGS. 9A and 9B are an illustration of a side view of a first interconnectable heating blanket and a second interconnectable heating blanket forming an interface in accordance with an illustrative embodiment.
Figure 9B:
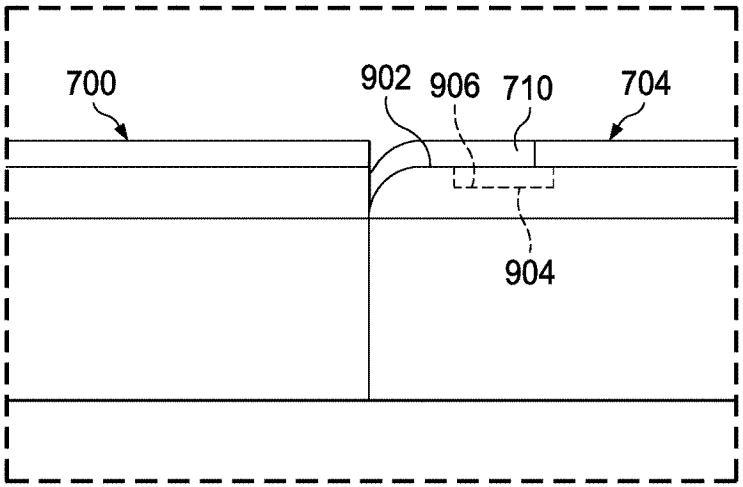

Turning now to FIGS. 9A and 9B, an illustration of a side view of a first interconnectable heating blanket and a second interconnectable heating blanket forming an interface is depicted in accordance with an illustrative embodiment. View 900 is a view of first interconnectable heating blanket 700 and second interconnectable heating blanket 704 from direction 9 of FIG. 7.

Second ledge 902 of second interconnectable heating blanket 704 is visible in view 900. Overlap of first flap 710 and second ledge 902 is visible in view 900.

First power connector 904 is incorporated into first flap 710. Second power connector 906 is incorporated into second ledge 902. When first flap 710 overlaps second ledge 902 as depicted, first power connector 904 and second power connector 906 are connected to provide power to first interconnectable heating blanket 700 and second interconnectable heating blanket 704 from a single power source.

Figure 10:
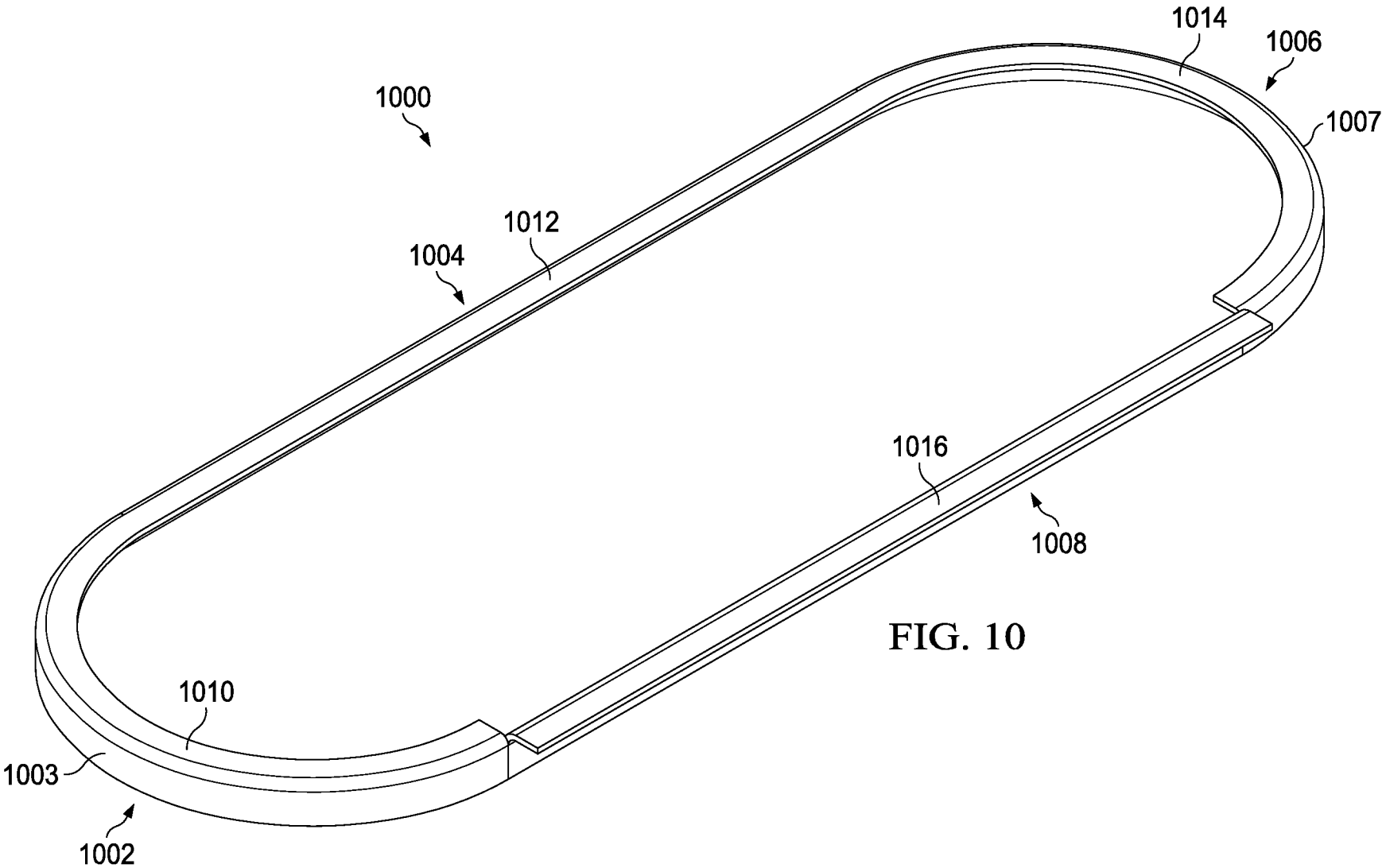
FIG. 10 is an illustration of a top isometric view of an interconnectable heating blanket in accordance with an illustrative embodiment.

Turning now to FIG. 10, an illustration of a top isometric view of an interconnectable heating blanket is depicted in accordance with an illustrative embodiment. Interconnectable heating blanket 1000 is a physical implementation of first interconnectable heating blanket 114 of FIG. 1.

As depicted, at least one of first side 1002, second side 1004, third side 1006, or fourth side 1008 is curved. In this illustrative example, first side 1002 is curved 1003 and third side 1006 is curved 1007. First side 1002 has ledge 1010. Second side 1004 has ledge 1012. Third side 1006 has ledge 1014. Fourth side 1008 has flap 1016.

The illustration of interconnectable heating blanket 1000 in FIG. 10 is not meant to imply physical or architectural limitations to the manner in which an illustrative embodiment may be implemented. A physical implementation of first interconnectable heating blanket 114 may have any desirable quantity of curved sides. Further, a physical implementation of first interconnectable heating blanket 114 may have any desirable quantity of sides. Yet further, each of first side 1002, second side 1004, third side 1006, or fourth side 1008 may be either of a flap or a ledge.

Figure 11:
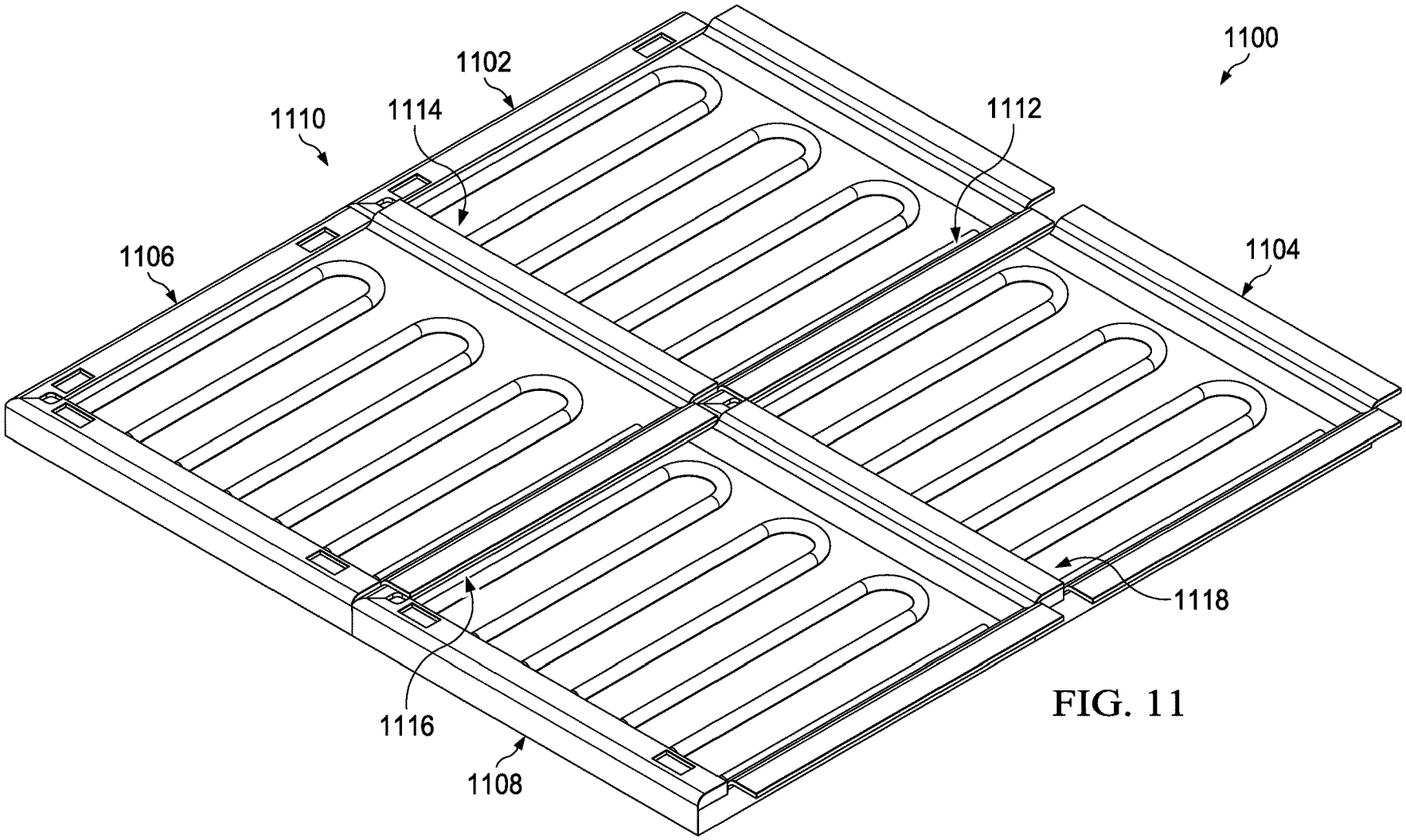
FIG. 11 is an illustration of a top isometric view of a plurality of interconnectable heating blankets joined together in accordance with an illustrative embodiment.

Turning now to FIG. 11, an illustration of a top isometric view of a plurality of interconnectable heating blankets joined together is depicted in accordance with an illustrative embodiment. In view 1100, interconnectable heating blanket 1102, interconnectable heating blanket 1104, interconnectable heating blanket 1106, and interconnectable heating blanket 1108 are joined to form system 1110. Each of interconnectable heating blanket 1102, interconnectable heating blanket 1104, interconnectable heating blanket 1106, and interconnectable heating blanket 1108 may be a physical implementation of first interconnectable heating blanket 114 or second interconnectable heating blanket 135 of FIG. 1. In some illustrative examples, any of interconnectable heating blanket 1102, interconnectable heating blanket 1104, interconnectable heating blanket 1106, and interconnectable heating blanket 1108 may be the same as interconnectable heating blanket 200 of FIG. 2.

Interconnectable heating blanket 1102 and interconnectable heating blanket 1104 form interface 1112. Interconnectable heating blanket 1102 and interconnectable heating blanket 1106 form interface 1114. Interconnectable heating blanket 1106 and interconnectable heating blanket 1108 form interface 1116. Interconnectable heating blanket 1104 and interconnectable heating blanket 1108 form interface 1118.

As a result of interface 1112, interface 1114, interface 1116, and interface 1118, each of interconnectable heating blanket 1102, interconnectable heating blanket 1104, interconnectable heating blanket 1106, and interconnectable heating blanket 1108 will be electrically connected to a single power source. Each of interface 1112, interface 1114, interface 1116, and interface 1118 include at least one power connection formed by attached power connectors of respective interconnectable heating blankets. For example, interface 1112 includes at least one power connection formed by attached power connectors of interconnectable heating blanket 1102 and interconnectable heating blanket 1104. In some illustrative examples, at least one of interface 1112, interface 1114, interface 1116, and interface 1118 includes more than one power connection.

After using system 1110 to heat an area of a component, each of interconnectable heating blanket 1102, interconnectable heating blanket 1104, interconnectable heating blanket 1106, and interconnectable heating blanket 1108 may be disconnected from each other of interconnectable heating blanket 1102, interconnectable heating blanket 1104, interconnectable heating blanket 1106, and interconnectable heating blanket 1108. Each of interconnectable heating blanket 1102, interconnectable heating blanket 1104, interconnectable heating blanket 1106, and interconnectable heating blanket 1108 may be at least one of reconnected or connected with other interconnectable heating blankets in a different configuration for future applications.

As depicted, system 1110 includes interconnectable heating blankets, interconnectable heating blanket 1102, interconnectable heating blanket 1104, interconnectable heating blanket 1106, and interconnectable heating blanket 1108, which are all the same dimensions. However, in other non-depicted illustrative examples, system 1110 may include more than one size or shape of interconnectable heating blankets. Additionally, in other non-depicted illustrative examples, system 1110 may include any desirable quantity of interconnectable heating blankets. At least one of the quantity, the size, or the shape of interconnectable heating blankets of system 1110 are selected based on a size and shape of an area to be heated.

Figure 12:
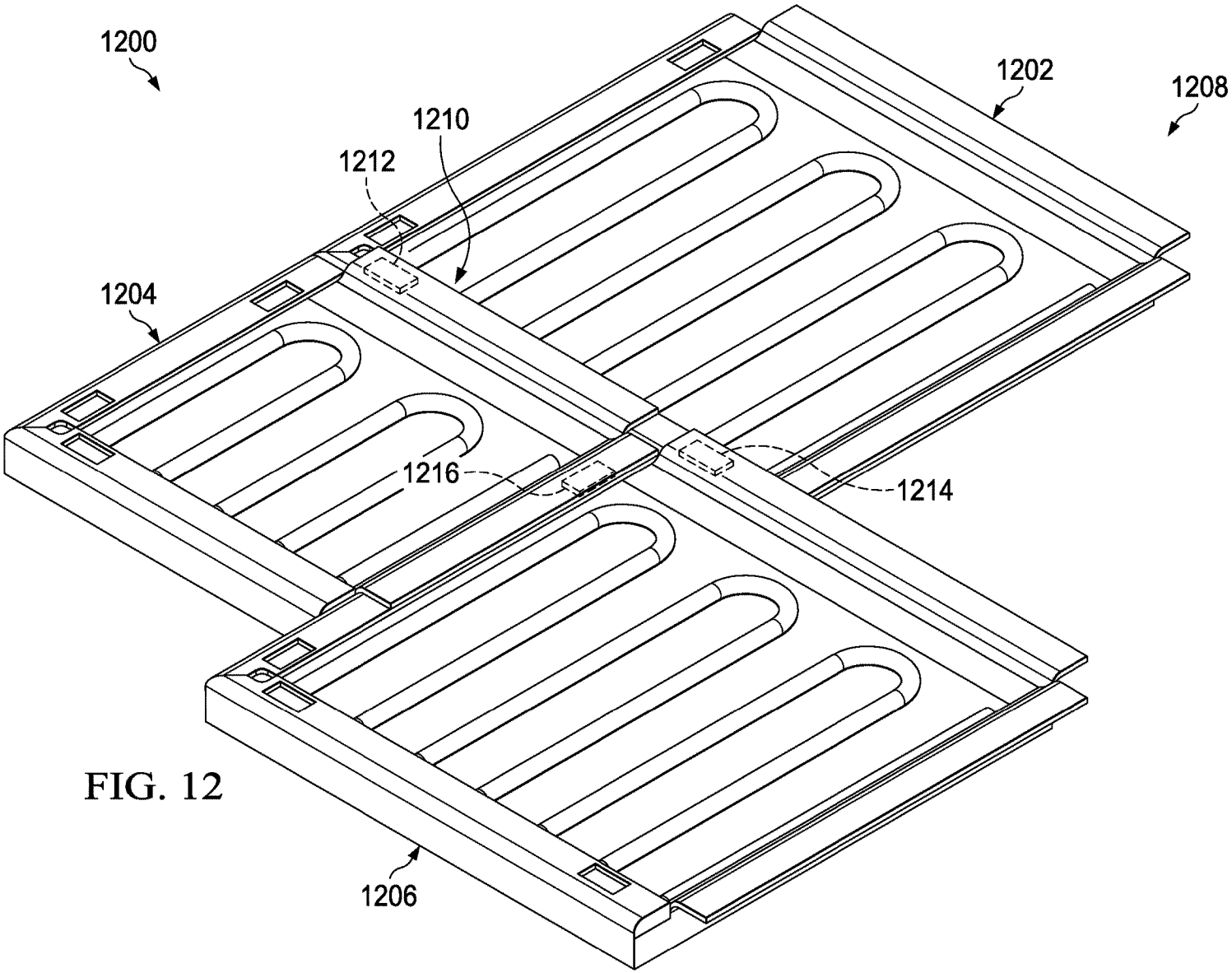
FIG. 12 is an illustration of a top isometric view of a plurality of interconnectable heating blankets joined together in accordance with an illustrative embodiment.

Turning now to FIG. 12, an illustration of a top isometric view of a plurality of interconnectable heating blankets joined together is depicted in accordance with an illustrative embodiment. In view 1200, interconnectable heating blanket 1202, interconnectable heating blanket 1204, and interconnectable heating blanket 1206 are joined to form system 1208. Each of interconnectable heating blanket 1202, interconnectable heating blanket 1204, and interconnectable heating blanket 1206 may be a physical implementation of first interconnectable heating blanket 114 or second interconnectable heating blanket 135 of FIG. 1.

In system 1208, more than one interconnectable heating blanket is connected to first edge 1210 of interconnectable heating blanket 1202. Interconnectable heating blanket 1204 is connected to power connector 1212 of first edge 1210 of interconnectable heating blanket 1202. Interconnectable heating blanket 1206 is connected to power connector 1214 of first edge 1210 of interconnectable heating blanket 1202.

As depicted, interconnectable heating blanket 1204 is connected to interconnectable heating blanket 1206. As depicted, interconnectable heating blanket 1204 is connected to power connector 1216 of interconnectable heating blanket 1206. Although interconnectable heating blanket 1204 is depicted as directly connected to interconnectable heating blanket 1206, interconnectable heating blanket 1204 and interconnectable heating blanket 1206 will be powered by a single power source without a direct connection.

Figure 13:
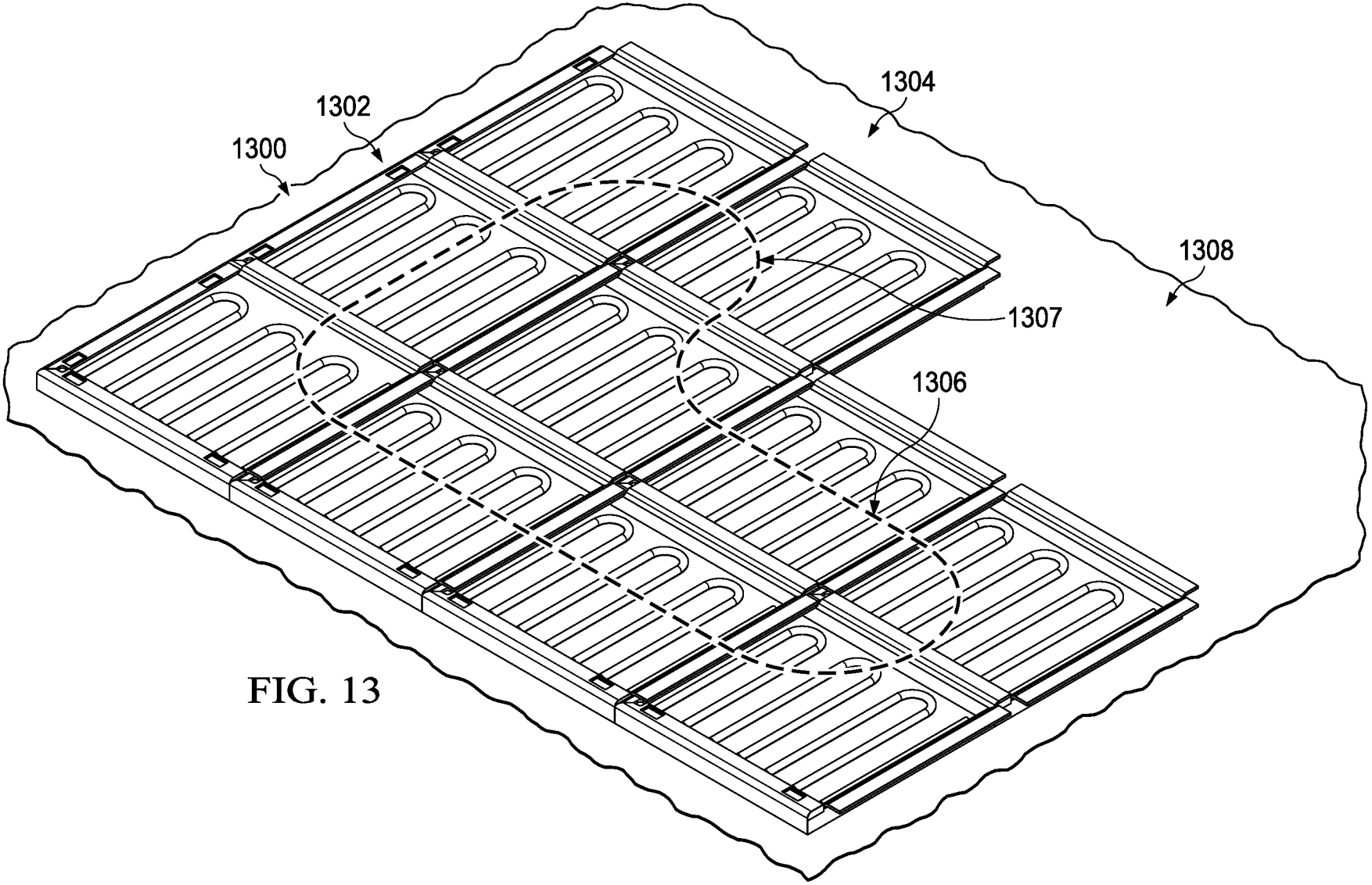
FIG. 13 is an illustration of a top isometric view of a plurality of interconnectable heating blankets over an area to be heated in accordance with an illustrative embodiment.

Turning now to FIG. 13, an illustration of a top isometric view of a plurality of interconnectable heating blankets over an area to be heated is depicted in accordance with an illustrative embodiment. Each of plurality of interconnectable heating blankets 1300 of system 1302 may be a physical implementation of first interconnectable heating blanket 114 of FIG. 1 or second interconnectable heating blanket 135 of FIG. 1. In some illustrative examples, each of plurality of interconnectable heating blankets 1300 have the design of interconnectable heating blanket 200 of FIG. 2.

As depicted, plurality of interconnectable heating blankets 1300 are joined together to form system 1302 such that each of plurality of interconnectable heating blankets 1300 may be powered by a single power source.

As depicted, plurality of interconnectable heating blankets 1300 are joined together to form footprint 1304 of system 1302. Footprint 1304 of system 1302 is selected to cover area to be heated 1306. As depicted, footprint 1304 substantially matches shape 1307 of area to be heated 1306. Area to be heated 1306 is an irregular shape. Footprint 1304 of system 1302 may be described as an "L-shape." By having an "L-shape," system 1302 heats a smaller area than would have been heated by a rectangular heating blanket large enough to cover area to be heated 1306.

Specifically, area 1308 is not covered by system 1302. A conventional heating blanket is large enough to cover area to be heated 1306 would also cover area 1308 would have been covered by a conventional rectangular heating blanket.

The illustrations in FIGS. 2-13 are not meant to imply physical or architectural limitations to the manner in which an illustrative embodiment may be implemented. For example, the illustrations in FIGS. 2-13 may not be to scale. For example, interconnectable heating blanket 200 of FIG. 2 may not be to scale. For example, the thickness of interconnectable heating blanket 200 of FIG. 2 may less than depicted in FIG. 2.

Figure 14:
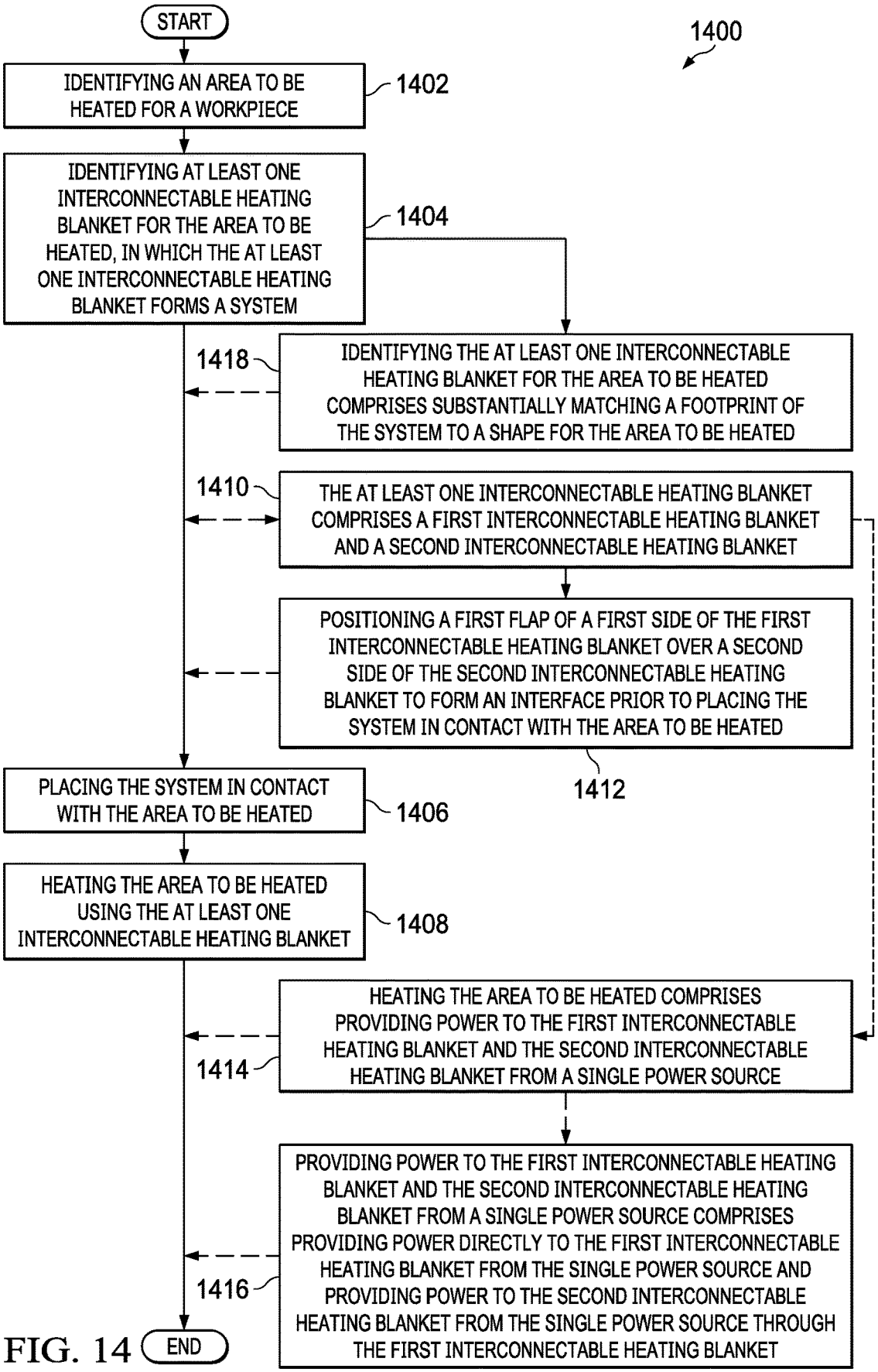
FIG. 14 is an illustration of a flowchart of a method for heating an area to be heated in accordance with an illustrative embodiment.

Turning now to FIG. 14, an illustration of a flowchart of a method for heating an area to be heated is depicted in accordance with an illustrative embodiment. Method 1400 is a method for using an interconnectable heating blanket such as first interconnectable heating blanket 114 or second interconnectable heating blanket 135 of FIG. 1. In some illustrative examples method 1400 may utilize interconnectable heating blanket 200 of FIG. 2. In some illustrative examples, method 1400 may utilize multiple interconnectable heating blankets, such as first interconnectable heating blanket 700 and second interconnectable heating blanket 704 of FIG. 7. In some illustrative examples, method 1400 may utilize multiple interconnectable heating blankets, such as system 1110 of FIG. 11, system 1208 of FIG. 12, or system 1302 of FIG. 13.

Method 1400 identifies an area to be heated for a workpiece (operation 1402). An area to be heated for the workpiece comprises an area to be heated. In some illustrative examples, identifying the area to be heated comprises identifying a size and shape of the area to be heated. In some illustrative examples, the area to be heated has an irregular shape.

Method 1400 identifies at least one interconnectable heating blanket for the area to be heated, in which the at least one interconnectable heating blanket forms a system (operation 1404). The at least one interconnectable heating blanket is identified to cover the area to be heated. The at least one interconnectable heating blanket is identified to provide a desired amount of heat to the area to be heated.

Method 1400 places the system in contact with the area to be heated (operation 1406). Method 1400 heats the area to be heated using the at least one interconnectable heating blanket (operation 1408). Afterwards, the method terminates.

In some illustrative examples, the at least one interconnectable heating blanket comprises a first interconnectable heating blanket and a second interconnectable heating blanket (operation 1410). In some illustrative examples, method 1400 further comprises positioning a first flap of a first side of the first interconnectable heating blanket over a second side of the second interconnectable heating blanket to form an interface prior to placing the system in contact with the area to be heated (operation 1412).

In some illustrative examples, heating the area to be heated comprises providing power to the first interconnectable heating blanket and the second interconnectable heating blanket from a single power source (operation 1414). In some illustrative examples, providing power to the first interconnectable heating blanket and the second interconnectable heating blanket from a single power source comprises providing power directly to the first interconnectable heating blanket from the single power source and providing power to the second interconnectable heating blanket from the single power source through the first interconnectable heating blanket (operation 1416). In some illustrative examples, identifying the at least one interconnectable heating blanket for the area to be heated comprises substantially matching a footprint of the system to a shape for the area to be heated (operation 1418).

Figure 15:
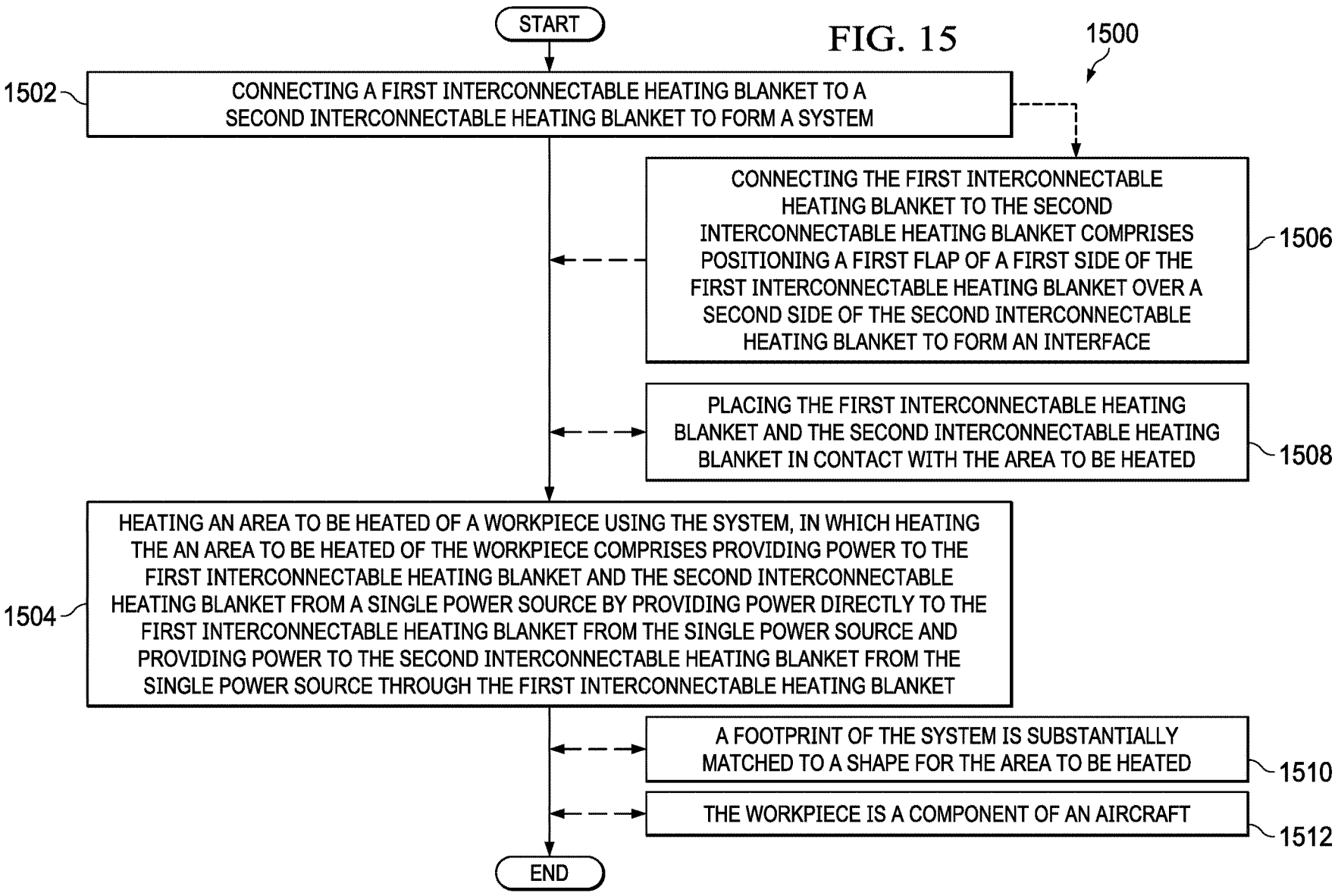
FIG. 15 is an illustration of a flowchart of a method for heating an area to be heated in accordance with an illustrative embodiment.

Turning now to FIG. 15, an illustration of a flowchart of a method for heating an area to be heated is depicted in accordance with an illustrative embodiment. Method 1500 is a method for using an interconnectable heating blanket such as first interconnectable heating blanket 114 or second interconnectable heating blanket 135 of FIG. 1. In some illustrative examples method 1500 may utilize interconnectable heating blanket 200 of FIG. 2. In some illustrative examples, method 1500 may utilize multiple interconnectable heating blankets, such as first interconnectable heating blanket 700 and second interconnectable heating blanket 704 of FIG. 7. In some illustrative examples, method 1500 may utilize multiple interconnectable heating blankets, such as system 1110 of FIG. 11, system 1208 of FIG. 12, or system 1302 of FIG. 13.

Method 1500 connects a first interconnectable heating blanket to a second interconnectable heating blanket to form a system (operation 1502). Method 1500 heats an area to be heated of a workpiece using the system, in which heating the area to be heated of the workpiece comprises providing power to the first interconnectable heating blanket and the second interconnectable heating blanket from a single power source by providing power directly to the first interconnectable heating blanket from the single power source and providing power to the second interconnectable heating blanket from the single power source through the first interconnectable heating blanket (operation 1504). Afterwards, the method terminates.

In some illustrative examples, in method 1500, connecting the first interconnectable heating blanket to the second interconnectable heating blanket comprises positioning a first flap of a first side of the first interconnectable heating blanket over a second side of the second interconnectable heating blanket to form an interface (operation 1506). In some illustrative examples, method 1500 further places the first interconnectable heating blanket and the second interconnectable heating blanket in contact with the area to be heated (operation 1508).

In some illustrative examples, a footprint of the system is substantially matched to a shape for the area to be heated (operation 1510). In some illustrative examples, the workpiece is a component of an aircraft (operation 1512).

The flowcharts and block diagrams in the different depicted embodiments illustrate the architecture, functionality, and operation of some possible implementations of apparatus and methods in an illustrative embodiment. In this regard, each block in the flowcharts or block diagrams may represent a module, a segment, a function, and/or a portion of an operation or step.

In some alternative implementations of an illustrative embodiment, the function or functions noted in the blocks may occur out of the order noted in the figures. For example, in some cases, two blocks shown in succession may be executed substantially concurrently, or the blocks may sometimes be performed in the reverse order, depending upon the functionality involved. Also, other blocks may be added, in addition to the illustrated blocks, in a flowchart or block diagram.

In some illustrative examples, not all blocks of method 1400 or method 1500 are performed. For example, operations 1410 through 1418 of FIG. 14 are optional. As another example, operations 1506 through 1512 of FIG. 15 are optional.

Figure 16:
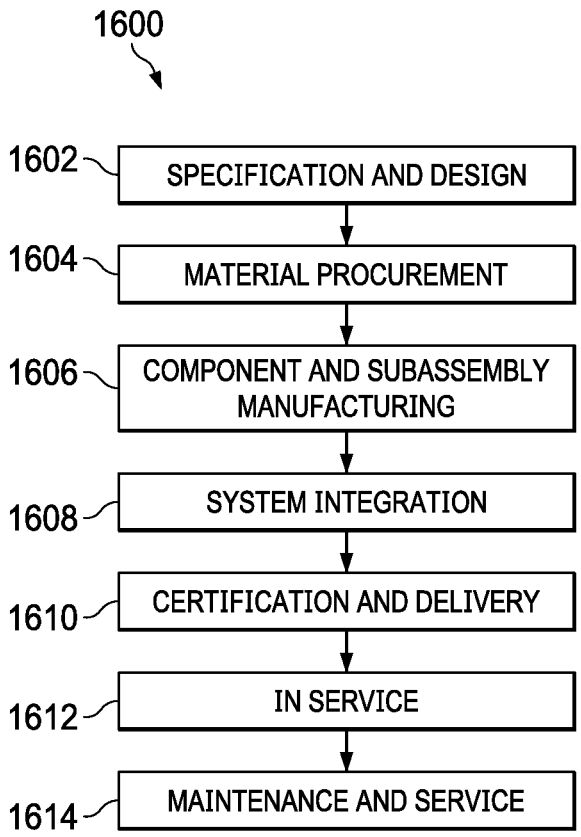
FIG. 16 is an illustration of an aircraft manufacturing and service method in the form of a block diagram in accordance with an illustrative embodiment.
Figure 17:
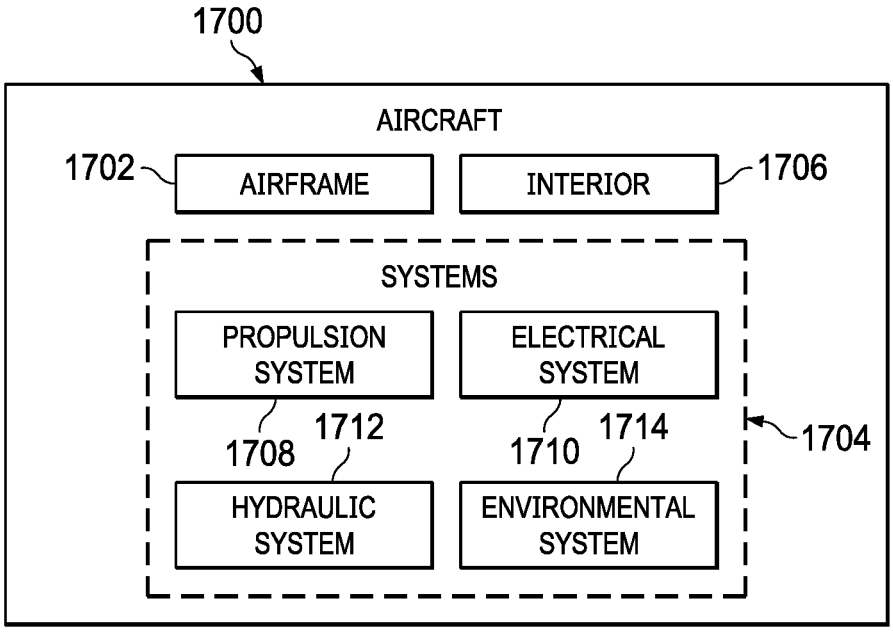
FIG. 17 is an illustration of an aircraft in the form of a block diagram in which an illustrative embodiment may be implemented.

The illustrative embodiments of the present disclosure may be described in the context of aircraft manufacturing and service method 1600 as shown in FIG. 16 and aircraft 1700 as shown in FIG. 17. Turning first to FIG. 16, an illustration of an aircraft manufacturing and service method is depicted in accordance with an illustrative embodiment. During pre-production, aircraft manufacturing and service method 1600 may include specification and design 1602 of aircraft 1700 in FIG. 17 and material procurement 1604.

During production, component and subassembly manufacturing 1606 and system integration 1608 of aircraft 1700 takes place. Thereafter, aircraft 1700 may go through certification and delivery 1610 in order to be placed in service 1612. While in service 1612 by a customer, aircraft 1700 is scheduled for maintenance and service 1614, which may include modification, reconfiguration, refurbishment, and other maintenance or service.

Each of the processes of aircraft manufacturing and service method 1600 may be performed or carried out by a system integrator, a third party, and/or an operator. In these examples, the operator may be a customer. For the purposes of this description, a system integrator may include, without limitation, any number of aircraft manufacturers or major-system subcontractors; a third party may include, without limitation, any number of vendors, subcontractors, or suppliers; and an operator may be an airline, a leasing company, a military entity, a service organization, and so on.

With reference now to FIG. 17, an illustration of an aircraft is depicted in which an illustrative embodiment may be implemented. In this example, aircraft 1700 is produced by aircraft manufacturing and service method 1600 in FIG. 16 and may include airframe 1702 with a plurality of systems 1704 and interior 1706. Examples of systems 1704 include one or more of propulsion system 1708, electrical system 1710, hydraulic system 1712, and environmental system 1714. Any number of other systems may be included. Although an aerospace example is shown, different illustrative embodiments may be applied to other industries, such as the automotive industry.

Apparatuses and methods embodied herein may be employed during at least one of the stages of aircraft manufacturing and service method 1600. One or more illustrative embodiments may be used during component and subassembly manufacturing 1606, system integration 1608, or maintenance and service 1614 of FIG. 16. For example, at least one of first interconnectable heating blanket 114 or second interconnectable heating blanket 135 of FIG. 1 may be used to heat a component during component and subassembly manufacturing 1606. As another example, at least one of first interconnectable heating blanket 114 or second interconnectable heating blanket 135 of FIG. 1 may be used to heat area to be heated 103 of FIG. 1 during maintenance and service 1614 of FIG. 16.

Apparatuses and methods embodied herein may be employed in manufacturing at least one component of aircraft 1700. For example, at least one of first interconnectable heating blanket 114 or second interconnectable heating blanket 135 of FIG. 1 may be used to heat a workpiece to form a portion of airframe 1702 or interior 1706.

The illustrative examples provide mechanically and electrically connectable, heating blankets. In some illustrative examples, the heating blankets may instead be referred to as heating patches or heating modules. Multiple interconnectable heat blankets can be magnetically assembled to provide desirable coverage across nearly any footprint. The interconnectable heating blankets may be of any desirable size or shape. The interconnectable heating blankets may be square, rectangular, triangular, or any other desirable shape. In some illustrative examples, the interconnectable heating blankets have rounded sides.

The illustrative examples provide interconnectable heat blankets of different sizes. In some illustrative examples, interconnectable heat blankets can be used to fit even unusual features or footprints. By fitting a footprint for heating, the interconnectable heat blankets may reduce or prevent heat-damage to surrounding structures or components.

In some illustrative examples, each interconnectable heating blanket can connect with more than one other interconnectable heating blanket on each of its edges. The quantity of heating blankets that may connect to each edge is determined by the quantity of power connectors positioned on each respective edge and the sizes of interconnectable heating blankets. When an edge has two power connectors, a maximum of two other interconnectable heating blankets may be connected to the edge. When an edge has only one power connector, only one interconnectable heating blanket may be connected to the edge.

In some illustrative examples, an interconnectable heating blanket has two male and two female edges with a line of symmetry extending diagonally through the interconnectable heating blanket. In some illustrative examples, the male edges are flexible flaps that overlay atop the static female edges and create mechanical and electrical connections, as well as thermal continuity between the heating blankets.

In the illustrative examples, there are no heating elements in the interface between two interconnectable heating blankets. The interface may also be referred to as a joint, a connection, or a transition. Conductive heating is present in the interface. In some illustrative examples, flaps are tapered to provide a desired transition of heat.

The flap, in addition to mechanically and electrically connecting the two interconnectable heating blankets, also acts as a gap insulator to transition the heat gradient from one heating blanket to the other and reduce cold spots which could result in less than desirable quality.

In some illustrative examples, the underside of the male flap is lined with a high strength natural magnet. This magnet can be segmented for improved flexibility. In some illustrative examples, both ends of the flap have a connection point. Each connection point includes a power connector. In some illustrative examples, each connection point includes three connectors (data, power and ground). These connectors are the termination point of wires which run inside the structure of the module.

Similarly, in some illustrative examples, the topside of the female connector is lined with a ferrous metallic strip. In some illustrative examples, both ends of the accepting surface include connection points. In some illustrative examples, each connection point has three receiving connectors (data, power, and ground).

One connection point is sufficient to tie a new interconnectable heating blanket into the system. As long as an interconnectable heating blanket is connected by at least one connection point with a power connector, the interconnectable heating blanket will be heated from the single power source. More than one power connector may be provided on each edge of an interconnectable heating blanket so that additional footprints may be constructed.

The description of the different illustrative embodiments has been presented for purposes of illustration and description, and is not intended to be exhaustive or limited to the embodiments in the form disclosed. Many modifications and variations will be apparent to those of ordinary skill in the art. Further, different illustrative embodiments may provide different features as compared to other illustrative embodiments. The embodiment or embodiments selected are chosen and described in order to best explain the principles of the embodiments, the practical application, and to enable others of ordinary skill in the art to understand the disclosure for various embodiments with various modifications as are suited to the particular use contemplated.

What is claimed is:

1. An interconnectable heating blanket comprising:

a first face;

a second face;

a plurality of sides including at least three sides and a first side forming a corner with a second side, wherein each side of the plurality of sides comprises a respective mechanical coupler and a plurality of power connectors;

the first side comprising a flap and a first plurality of power connectors incorporated into the flap;

the second side comprising a ledge and a second plurality of power connectors incorporated into the ledge;

wherein the flap of the first side is adapted to form a first interface with a ledge of a first other interconnectable heating blanket and wherein the ledge of the second side is adapted to form a second interface with a flap of a second other interconnectable heating blanket; and a series of heating elements encompassed by a polymeric material;

wherein the interconnectable heating blanket is configured to heat at least a portion of an area to be heated of a component of an aircraft using heat from the series of heating elements transmitted through the first face and wherein the component of the aircraft comprises composite material and the heat from the series of heating elements is configured to form the component.

2. The interconnectable heating blanket of claim 1, wherein a side of the plurality of sides forms an interface with a first other interconnectable heating blanket and a second other interconnectable heating blanket simultaneously, wherein the interface is an electrical connection such that a first power connector of the side of the plurality of sides is connected to a power connector of the first other interconnectable heating blanket and a second power connector of the side of the plurality of sides is connected to a power connector of the second other interconnectable heating blanket, and wherein the interface is a mechanical connection such that a respective mechanical coupler of the side of the plurality of sides is connected to a respective mechanical coupler of the first other interconnectable heating blanket and the respective mechanical coupler of the side of the plurality of sides is connected to a respective mechanical coupler of the second other interconnectable heating blanket.

3. The interconnectable heating blanket of claim 1, wherein each respective mechanical coupler is at least one of a magnetic material or a ferromagnetic material.

4. The interconnectable heating blanket of claim 1, wherein the series of heating elements extends to within one inch or less of each of the plurality of sides and wherein the flap is a gap insulator at the first interface and is configured to transition a heat gradient from the interconnectable heating blanket to the first other interconnectable heating blanket.

5. The interconnectable heating blanket of claim 1, wherein the plurality of power connectors includes a power connection, a data connection, and a ground.

6. The interconnectable heating blanket of claim 1, wherein the plurality of sides further comprises a third side forming a corner with a fourth side and wherein at least one of the first side, the second side, the third side, or the fourth side is curved.

7. The interconnectable heating blanket of claim 1, wherein the flap of the first side or the ledge of the second side is adapted to form an interface with more than one other interconnectable heating blanket simultaneously, wherein the interface is a mechanical and electrical connection.

8. The interconnectable heating blanket of claim 7, wherein the interconnectable heating blanket and the more than one other interconnectable heating blanket are electrically connected to a single power source.

9. A system comprising:

a first interconnectable heating blanket comprising at least three sides and with a first side comprising a flap and a second side comprising a ledge, the first side forming a corner with the second side, and each side of the at least three sides comprising a respective mechanical coupler and a plurality of power connectors;

a second interconnectable heating blanket with a side comprising a ledge, in which the flap of the first side of the first interconnectable heating blanket overlaps the ledge of the second interconnectable heating blanket to form an interface and wherein the ledge of the second side of the first interconnectable heating blanket is adapted to form a second interface with a flap of a third interconnectable heating blanket;

a single power source electrically connected to the first interconnectable heating blanket and the second interconnectable heating blanket; and a series of heating elements encompassed by a polymeric material for each of the first interconnectable heating blanket and the second interconnectable heating blanket;

wherein each of the first interconnectable heating blanket and the second interconnectable heating blanket is configured to heat at least a portion of an area to be heated of a component of an aircraft using heat transmitted from the series of heating elements and wherein the component of the aircraft comprises composite material and the heat from the series of heating elements is configured to form the component.

10. The system of claim 9, wherein the series of heating elements of the first interconnectable heating blanket extends to within one inch or less from a first edge of the first side.

11. The system of claim 9, wherein spacing between the series of heating elements of the first interconnectable heating blanket and the series of heating elements of the second interconnectable heating blanket at the interface is the same as spacing between each heating element of the series of heating elements of the first interconnectable heating blanket.

12. The system of claim 9, wherein a footprint of the system is matched to a shape for the area to be heated.

13. The system of claim 9, wherein the flap of the first side of the first interconnectable heating blanket comprises polymeric material with a first power connector incorporated into the flap.

14. The system of claim 13, wherein the third side of the second interconnectable heating blanket has a second power connector incorporated into the second ledge, wherein the first power connector and the second power connector are connected to provide power to the first interconnectable heating blanket and the second interconnectable heating blanket from the single power source.

15. The system of claim 14, wherein each of the first power connector and the second power connector include a power connection, a data connection, and a ground.

16. The system of claim 14, wherein the flap comprises a magnetic material, and wherein the second ledge comprises a magnetic material or a ferromagnetic material.

17. An interconnectable heating blanket comprising:

at least three sides, wherein each side of the at least three sides comprises a respective mechanical coupler and a plurality of power connectors;

a first side having a first flap of polymeric material overhanging a first edge, wherein the first flap has a first power connector incorporated into the first flap;

a second side forming a corner with the first side, the second side having a second ledge with a second power connector incorporated into the second ledge;

wherein the first flap of the first side is adapted to form a first interface with a ledge of a first other interconnectable heating blanket and wherein the second ledge of the second side is adapted to form a second interface with a flap of a second other interconnectable heating blanket such that the first interface forms a first mechanical connection and a first electrical connection between the flap of the first side and the ledge of the first other interconnectable heating blanket and the second interface forms a second mechanical connection and a second electrical connection between the second ledge of the second side and the flap of the second other interconnectable heating blanket; and a series of heating elements encompassed by a polymeric material;

wherein the interconnectable heating blanket is configured to heat at least a portion of an area to be heated of a component of an aircraft using heat from the series of heating elements transmitted through a first face of the interconnectable heating blanket and wherein the component of the aircraft comprises composite material and the heat from the series of heating elements is configured to form the component.

18. The interconnectable heating blanket of claim 17, wherein the series of heating elements extends to within one inch or less from the first edge.

19. The interconnectable heating blanket of claim 17, wherein the interconnectable heating blanket is symmetrical.

20. The interconnectable heating blanket of claim 17, wherein the first flap comprises a magnetic material, and wherein the second ledge comprises a magnetic material or a ferromagnetic material.

21. The interconnectable heating blanket of claim 17, wherein the first side further comprises a third power connector incorporated into the first flap.

22. The interconnectable heating blanket of claim 21, wherein the second side further comprises a fourth power connector incorporated into the second ledge.

23. The interconnectable heating blanket of claim 17 further comprising:

a third side having a third flap of polymeric material overhanging a third edge, wherein the third flap has a third power connector incorporated into the third flap; and a fourth side having a fourth ledge with a fourth power connector incorporated into the fourth ledge.

24. The interconnectable heating blanket of claim 23, wherein the first side and the third side are adjacent and perpendicular to each other.

25. The interconnectable heating blanket of claim 23, wherein at least one of the first side, second side, third side, or fourth side is curved.

26. A method comprising:

identifying an area to be heated for a workpiece;

identifying at least one interconnectable heating blanket for the area to be heated, in which the at least one interconnectable heating blanket forms a system and wherein the at least one interconnectable heating blanket comprises at least three sides, wherein each side of the at least three sides comprises a respective mechanical coupler and a plurality of power connectors, a first side comprising a flap of polymeric material overhanging an edge and a second side forming a corner with the first side, the second side comprising a ledge, wherein the flap of the first side is adapted to form a first interface with a ledge of a first other interconnectable heating blanket of the system and wherein the ledge of the second side is adapted to form a second interface with a flap of a second other interconnectable heating blanket of the system, wherein the at least one interconnectable heating blanket comprises a series of heating elements encompassed by a polymeric material, and wherein the at least one interconnectable heating blanket is configured to heat the area to be heated for the workpiece using heat transmitted from the series of heating elements and wherein the workpiece comprises composite material and the heat from the series of heating elements is configured to form the workpiece, wherein the workpiece is a component of an aircraft;

placing the system in contact with the area to be heated; and heating the area to be heated using the system.

27. The method of claim 26, wherein identifying the at least one interconnectable heating blanket for the area to be heated comprises substantially matching a footprint of the system to a shape for the area to be heated.

28. The method of claim 26, wherein the plurality of power connectors includes a power connection, a data connection, and a ground.

29. The method of claim 26, wherein the at least one interconnectable heating blanket comprises a first interconnectable heating blanket and a second interconnectable heating blanket, the method further comprising:

positioning a first flap of a first side of the first interconnectable heating blanket over a second side of the second interconnectable heating blanket to form an interface prior to placing the system in contact with the area to be heated.

30. The method of claim 29, wherein heating the area to be heated comprises providing power to the first interconnectable heating blanket and the second interconnectable heating blanket from a single power source.

31. The method of claim 30, wherein providing power to the first interconnectable heating blanket and the second interconnectable heating blanket from a single power source comprises providing power directly to the first interconnectable heating blanket from the single power source and providing power to the second interconnectable heating blanket from the single power source through the first interconnectable heating blanket.

32. A method comprising:

connecting a first interconnectable heating blanket to a second interconnectable heating blanket to form a system, the first interconnectable heating blanket comprising at least three sides, wherein each side of the at least three sides comprises a respective mechanical coupler and a plurality of power connectors, a first side comprising a flap of polymeric material overhanging an edge and a second side comprising a ledge, the first side forming a corner with the second side, the second interconnectable heating blanket with a third side comprising a second ledge, in which the flap of the first side of the first interconnectable heating blanket overlaps the second ledge of the third side of the second interconnectable heating blanket to form an interface and wherein the ledge of the second side of the first interconnectable heating blanket is adapted to form a second interface with a flap of a third interconnectable heating blanket, wherein each of the first interconnectable heating blanket and the second interconnectable heating blanket comprise a series of heating elements encompassed by a polymeric material, wherein each of the first interconnectable heating blanket and the second interconnectable heating blanket is configured to heat an area to be heated of a workpiece using heat transmitted from the series of heating elements and wherein the workpiece comprises composite material and the heat from the series of heating elements is configured to form the workpiece, wherein the workpiece is a component of an aircraft; and heating the area to be heated of the workpiece using the system, in which heating the area to be heated of the workpiece comprises providing power to the first interconnectable heating blanket and the second interconnectable heating blanket from a single power source by providing power directly to the first interconnectable heating blanket from the single power source and providing power to the second interconnectable heating blanket from the single power source through the first interconnectable heating blanket.

33. The method of claim 32, wherein a footprint of the system is substantially matched to a shape for the area to be heated.

34. The method of claim 32, wherein the plurality of power connectors includes a power connection, a data connection, and a ground.

35. The method of claim 32, wherein connecting the first interconnectable heating blanket to the second interconnectable heating blanket comprises positioning the flap of the first side of the first interconnectable heating blanket over the third side of the second interconnectable heating blanket to form the interface.

36. The method of claim 35 further comprising:

placing the first interconnectable heating blanket and the second interconnectable heating blanket in contact with the area to be heated.

* * * * *